US009417595B2

(12) United States Patent
Takai et al.

(10) Patent No.: US 9,417,595 B2
(45) Date of Patent: Aug. 16, 2016

(54) IMAGE FORMING APPARATUS

(71) Applicant: KONICA MINOLTA, INC., Chiyoda-ku, Tokyo (JP)

(72) Inventors: Takayuki Takai, Anjo (JP); Takuya Okada, Toyokawa (JP); Takashi Kawanago, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/831,477

(22) Filed: Aug. 20, 2015

(65) Prior Publication Data

US 2016/0054700 A1 Feb. 25, 2016

(30) Foreign Application Priority Data

Aug. 21, 2014 (JP) ..... 2014-168676

(51) Int. Cl.
*G03G 21/00* (2006.01)

(52) U.S. Cl.
CPC ..... *G03G 21/0035* (2013.01); *G03G 21/0076* (2013.01)

(58) Field of Classification Search
CPC ..... G03G 21/0035; G03G 2221/0005
See application file for complete search history.

(56) References Cited

U.S. PATENT DOCUMENTS

2006/0222425 A1* 10/2006 Facci ..... G03G 21/0035 399/353
2007/0230994 A1 10/2007 Takishita
2009/0092428 A1* 4/2009 Yano ..... G03G 21/0035 399/349
2013/0223872 A1 8/2013 Aiba et al.

FOREIGN PATENT DOCUMENTS

| | | | |
|---|---|---|---|
| JP | 1-295289 | A | 11/1989 |
| JP | 2007-279121 | A | 10/2007 |
| JP | 2009-300814 | A | 12/2009 |
| JP | 2010-160448 | A | 7/2010 |
| JP | 2010-256454 | A | 11/2010 |
| JP | 2011-128363 | A | 6/2011 |
| JP | 2012-139488 | A | 7/2012 |
| JP | 2013-57811 | A | 3/2013 |
| JP | 2013-210612 | A | 10/2013 |

* cited by examiner

*Primary Examiner* — Roy Y Yi
(74) *Attorney, Agent, or Firm* — Buchanan Ingersoll & Rooney PC

(57) ABSTRACT

An image forming apparatus transfers a toner image formed on an image carrier having a moving surface onto a transfer object, and includes: a cleaning member that performs a removal operation on residues remaining on the image carrier after transfer of the toner image; and a brush member that has bristles including original yarns with uneven surfaces formed by microparticles adhering to and coating the original yarns, and comes into contact with the image carrier, on a downstream side relative to the cleaning member in a movement direction of the surface of the image carrier, to remove part of the residues that remains unremoved on the image carrier even after the removal operation performed by the cleaning member.

13 Claims, 12 Drawing Sheets

(a)

(b)

IMAGE FORMING APPARATUS

This application is based on applications No. 2014-168676 filed in Japan, the contents of which are hereby incorporated by reference.

BACKGROUND OF THE INVENTION (1) Field of the Invention

The present invention relates to an image forming apparatus that transfers toner images formed on an image carrier onto transfer objects.

(2) Related Art

An image forming apparatus such as a printer employing an electronic photography system has a configuration in which toner images are formed on an image carrier such as a photosensitive drum and intermediate transfer belt, and the toner images formed on the image carrier are transferred onto recording sheets such as sheets of paper.

According to this configuration, although it is ideal that all the toner images on the image carrier are transferred onto the recording sheets, part of toner particles actually sometimes remains, as residual toners, on the image carrier without being transferred. Also, there is a case where paper powders, which are generated due to contact with the sheets of paper, toner micropowders, which are generated by grinding toner particles, external additive particles, which are isolated from toner particles, and the like are deposited on the image carrier, in addition to residual toners.

If residual toners, paper powders, micro toner powders, external additive particles, and the like remain deposited on a surface of the image carrier, subsequent formation of toner images will be interfered with. For this reason, a cleaning unit is provided for cleaning the surface of the image carrier.

Such a cleaning unit has a typical configuration of scraping and removing residues on the image carrier by bringing a cleaning blade, a brush, or the like into contact with the image carrier which is rotating.

According to the configuration in which the cleaning blade, the brush, or the like is used, residual toners having a comparatively large size (in units of μm, for example) are easily removed. However, there is often a case where paper powders, external additive particles, and the like having a much smaller size (in units of, nm for example) than the residual toners cannot be completely removed from the surface of the image carrier. This is because the paper powders, the external additive particles, and the like are fine and accordingly are higher than the residual toners in terms of adhesive force (such as the Van der Waals force) relative to the surface of the image carrier.

If such micro paper powders, external additive particles, and the like remain deposited on the surface of the image carrier and then stick to the surface of the image carrier, a so-called filming easily occurs on the surface of the image carrier. In the case where filming occurs, difference is generated in transfer current between a region where the filming occurs and a region where no filming occurs on the surface of the image carrier due to difference in volume resistance therebetween. This causes non-uniform transfer, and results in non-uniform density in formed images.

Particularly in recent years, low-temperature fusing toners for fixing toners at a low temperature are used for the purpose of energy saving, and temperature inside the printer increases in accordance with the increase in printing speed. As a result, micro toner powders easily fuse due to the increase in the temperature inside the printer. Accordingly, paper powders, external additive particles, and the like tend to mix with the fused micro toner powders on the image carrier, and to be deposited on and stick to the image carrier. This tends to increase growth speed of a filming. Accordingly, early occurrence of filming easily results in formed image with uniform density. In view of this, improvement of cleaning properties is demanded.

SUMMARY OF THE INVENTION

The present invention aims to provide an image forming apparatus with a further improved cleaning properties in a configuration of removing residues on an image carrier such as a photosensitive drum.

The above aims is achieved by an image forming apparatus that transfers a toner image formed on an image carrier having a moving surface onto a transfer object, the image forming apparatus comprising: a cleaning member that performs a removal operation on residues remaining on the image carrier after transfer of the toner image; and a brush member that has bristles including original yarns with uneven surfaces formed by microparticles adhering to and coating the original yarns, and comes into contact with the image carrier, on a downstream side relative to the cleaning member in a movement direction of the surface of the image carrier, to remove part of the residues that remains unremoved on the image carrier even after the removal operation performed by the cleaning member.

BRIEF DESCRIPTION OF THE DRAWINGS

These and other objects, advantages and features of the invention will become apparent from the following description thereof taken in conjunction with the accompanying drawings those illustrate a specific embodiment of the invention.

In the drawings.

DESCRIPTION OF PREFERRED EMBODIMENTS

The following describes embodiments of an image forming apparatus relating to the present invention, with use of a tandem-type color printer (hereinafter, referred to simply as printer).

Embodiment 1

(1) Overall Configuration of Printer

Figure 1:
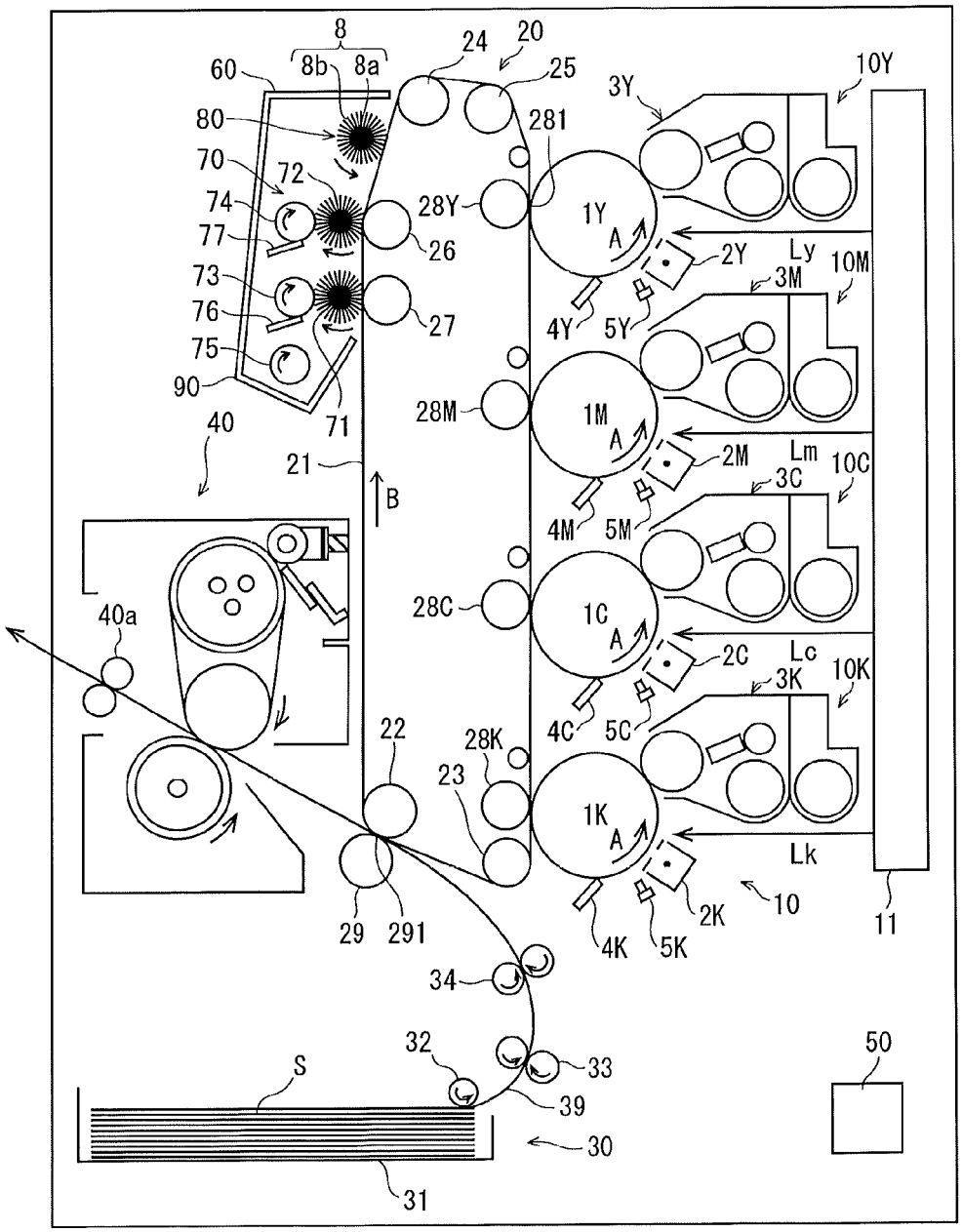
FIG. 1 shows the overall configuration of a printer relating to Embodiment 1.

FIG. 1 shows the overall configuration of a printer.

As shown in the figure, the printer forms images by a known electronic photography system, and includes an image process unit 10, an intermediate transfer unit 20, a paper feed unit 30, a fixing unit 40, a control unit 50, a belt cleaning unit 60, and so on. The printer is connected with a network such as LAN to receive an instruction to execute a print job from an external terminal device (not illustrated). Upon receipt of such an instruction, the printer forms a color image of yellow, magenta, cyan, and black colors. In the following description, respective reproduction colors of yellow, magenta, cyan, and black are denoted as Y, M, C, and K, respectively, and any compositional element related to one of the reproduction colors is denoted by a reference sign attached with an appropriate subscript Y, M, C, or K.

The image process unit 10 includes image forming subunits 10Y, 10M, 10C, and 10K respectively corresponding to the Y, M, C, and K colors, and an exposure subunit 11.

The image forming subunits 10Y, 10M, 10C, and 10K respectively include photosensitive drums 1Y, 1M, 1C, and 1K, and also respectively include chargers 2Y, 2M, 2C, and 2K, developers 3Y, 3M, 3C, and 3K, drum cleaners 4Y, 4M, 4C, 4K, dischargers 5Y, 5M, 5C, and 5K, which are each disposed about a corresponding one of the photosensitive drums 1Y, 1M, 1C, and 1K. The photosensitive drums 1Y, 1M, 1C, and 1K rotate in a direction indicated by an arrow A. The image forming subunits 10Y, 10M, 10C, and 10K respectively form toner images of colors corresponding to the photosensitive drums 1Y, 1M, 1C, and 1K.

The intermediate transfer unit 20 includes an intermediate transfer belt 21, a driving roller 22, driven rollers 23 through 27, primary transfer rollers 28Y, 28M, 28C, and 28K, a secondary transfer roller 29, and so on. The primary transfer rollers 28Y, 28M, 28C, and 28K are respectively disposed to face the photosensitive drums 1Y, 1M, 1C, and 1K with the intermediate transfer belt 21 therebetween. The secondary transfer roller 29 is disposed to face the driving roller 22 via the intermediate transfer belt 21.

The intermediate transfer belt 21 is suspended with tension by the driving roller 22, the driven rollers 23 through 27, and so on, and circularly runs by a rotation driving force of the driving roller 22 in a direction indicated by an arrow B (belt running direction). The driving roller 22 is driven to rotate by a motor which is not illustrated.

The paper feed unit 30 includes a paper feed cassette 31, a pickup roller 32, a pair of conveyance rollers 33, a pair of timing rollers 34, and so on.

The paper feed cassette 31 houses therein sheets S as recording sheets. The pickup roller 32 picks up the sheets S, which are housed in the paper feed cassette 31, to a convey path 39 piece by piece.

The pair of conveyance rollers 33 convey the sheets 5, which are picked up, further downstream on the convey path 39 in a conveyance direction. The pair of timing rollers 34 adjusts a timing of sending each of the conveyed sheets S to a secondary transfer position 291 where the secondary transfer roller 29 is in contact with the intermediate transfer belt 21.

The fixing unit 40 forms a nip by bringing a pressure roller into pressure-contact with a fixing roller, and maintains a temperature necessary for fixing by heating the fixing roller with use of a heater.

The belt cleaning unit 60 is disposed around the intermediate transfer belt 21, specifically, in a space from the secondary transfer position 291 to a primary transfer position 281 in the belt running direction (direction indicated by the arrow B). The primary transfer position 281 is a position where the photosensitive drum 1Y faces the primary transfer roller 28Y with the intermediate transfer belt 21 therebetween.

The control unit 50 converts image signals received from an external terminal device to image signals for the Y, M, C, and K colors to generate drive signals for driving laser diodes (not illustrated) for the Y, M, C, and K colors that are provided in the exposure subunit 11. The exposure subunit 11 emits respective laser beams Ly, Lm, Lc, and Lk for the Y, M, C, and K colors in accordance with the generated drive signals to perform exposure-scanning on the photosensitive drums 1Y, 1M, 1C, and 1K.

Prior to the exposure-scanning, the photosensitive drums 1Y, 1M, 1C, and 1K are discharged by the dischargers 5Y, 5M, 5C, and 5K, respectively, and then uniformly charged by the chargers 2Y, 2M, 2C, and 2K, respectively. As a result of exposure by the laser beams Ly, Lm, Lc, and Lk, an electrostatic latent image is formed on a circumferential surface of each of the photosensitive drums 1Y, 1M, 1C, and 1K.

The electrostatic latent images for the Y, M, C, and K colors are developed with use of toner by developer housed in the developers 3Y, 3M, 3C, and 3K, respectively. The development is performed with use of toner particles having a negative polarity and an average particle diameter of approximately 5 μm to 10 μm. Also, the toner particles contain external additive for improving electrostatic properties and liquidity. The external additive is for example metal oxide such as titanium oxide, alumina, zirconia, and silica, titanic acid compound such as strontium titanate and barium titanate, and the like.

The respective toner images of the Y, M, C, and K colors, which are formed on the photosensitive drums 1Y, 1M, 1C, and 1K by the development, are each primarily transferred onto the intermediate transfer belt 21 by the action of an electrostatic force caused by an electric field generated between a corresponding one of the photosensitive drums 1Y, 1M, 1C, and 1K and a corresponding one of the primary transfer rollers 28Y, 28M, 28C, and 28K to which positive polarity voltage is applied.

An image forming operation for each of the Y, M, C, and K colors is started in accordance with a different timing such that the respective toner images of the Y, M, C, and K colors are multi-transferred in layered form on the same position on the intermediate transfer belt 21. The toner images, which are multi-transferred on the intermediate transfer belt 21, are moved to the secondary transfer position 291 by the intermediate transfer belt 21 circularly running.

In accordance with the timing of the above image forming operation, sheets S are fed by the paper feed unit 30 via the pair of timing rollers 34. When a sheet S passes through between the secondary transfer roller 29 and the intermediate transfer belt 21, the respective toner images of the Y, M, C, and K colors, which are on the intermediate transfer belt 21, are secondarily transferred all at once onto the sheet S on the secondary transfer position 291 by the action of an electrostatic force caused by an electric field generated between the intermediate transfer belt 21 and the secondary transfer roller 29 to which a positive polarity voltage is applied.

After passing through the secondary transfer position 291, the sheet S is conveyed to the fixing unit 40. When the sheet S passes through the fixing nip, the toner images are heated and pressed to be fixed to the sheet S, and then the sheet S is ejected outside of the printer by a pair of ejection rollers 40*a*.

Residues of the toner images on the photosensitive drums 1Y, 1M, 1C, and 1K such as toners and external additive, which are remaining on the photosensitive drums 1Y, 1M, 1C, and 1K without being primarily transferred onto the intermediate transfer belt 21, are respectively removed by the drum cleaners 4Y, 4M, 4C, and 4K.

Also, residues including toners remaining on the intermediate transfer belt 21 without being secondarily transferred onto the sheets S on the secondary transfer position 291 and paper powders deposited on the intermediate transfer belt 21 from sheets S due to the contact with the sheets S are removed by the belt cleaning unit 60. Note that residues include micro toner powders and external additive particles in addition to residual toners and paper powders.

Here, most of residual toners has an average particle diameter in units of micrometers (μm), whereas much of paper powders, micro toner powders, and external additive particles has an average particle diameter in units of nanometers (nm), which is much smaller than residual toners. Furthermore, upon being influenced by an electric field generated by the positive polarity voltage applied during the transfer, only part of residual toners charges to positive polarity which is opposite to the original negative polarity.

(2) Configuration of Belt Cleaning Unit

The belt cleaning unit 60 includes a first cleaning subunit 70, a second cleaning subunit 80, and a housing 90. Here, the housing 90 is formed from insulating resin or the like. The housing 90 houses therein the first cleaning subunit 70 and the second cleaning subunit 80, and has an opening that faces the intermediate transfer belt 21.

(2-1) Configuration of First Cleaning Subunit

The first cleaning subunit 70 includes cleaning brushes 71 and 72, collection rollers 73 and 74, a conveyance screw 75, flickers 76 and 77, and so on.

Here, the cleaning brushes 71 and 72, the collection rollers 73 and 74, the conveyance screw 75, and the flickers 76 and 77 are each elongated along a width direction of the intermediate transfer belt 21 (a direction perpendicular to the paper surface in the figure, that is, a direction perpendicular to the belt running direction B). Hereinafter, the width direction of the intermediate transfer belt 21 is referred to as a belt width direction W.

The cleaning brushes 71 and 72 are disposed in the opening of the housing 90 such that the cleaning brush 71 is positioned on the upstream side relative to the cleaning brush 72 in the belt running direction B.

The cleaning brushes 71 and 72 each include a metal core and fibers that are implanted on an outer circumference of the metal core. The cleaning brushes 71 and 72 each rotate in a direction indicated by an arrow in the figure. When tips of the fibers come into sliding-contact with the surface of the intermediate transfer belt 21, the cleaning brushes 71 and 72 each mechanically scrape residues on the intermediate transfer belt 21 by using the tips of the fibers. Note that the cleaning brushes 71 and 72 are each a rotary body that has bristles including original yarns whose surfaces do not have microparticles adhered thereto, which are described later.

Negative polarity bias voltage is applied to the metal core of the cleaning brush 71, whereas positive polarity bias voltage is applied to the metal core of the cleaning brush 72.

Accordingly, an electric field is generated between the cleaning brush 71 and the intermediate transfer belt 21. This electric filed causes positively-charged residual toners, which are included in residues remaining on the intermediate transfer belt 21 after the secondary transfer, to act an electrostatic force in a direction from the intermediate transfer belt 21 toward the cleaning brush 71. As a result, the residual toners are easily absorbed into the cleaning brush 71.

Similarly, an electric field is generated that causes negatively-charged residual toners, which are included in the residues on the intermediate transfer belt 21, to act an electrostatic force in a direction from the intermediate transfer belt 21 toward the cleaning brush 72. As a result, the residual toners are easily absorbed into the cleaning brush 72.

Negative polarity bias voltage is applied to the collection roller 73. The collection roller 73 rotates in a direction indicated by an arrow in the figure while being in contact with the cleaning brush 71. The collection roller 73 collects residues such as residual toners absorbed into the cleaning brush 71 by a scraping force generated by the contact with the cleaning brush 71 and an electrostatic force generated by the bias voltage.

Positive polarity bias voltage is applied to the collection roller 74. The collection roller 74 rotates in a direction indicated by an arrow in the figure while being in contact with the cleaning brush 72. The collection roller 74 collects residues such as residual toners absorbed into the cleaning brush 72 by a scraping force generated by the contact with the cleaning brush 72 and an electrostatic force generated by the bias voltage.

The flicker 76 is a thin plate-like member, and scrapes the residues which are collected by the collection roller 73 by coming into contact with a surface of the collection roller 73. The scraped residues drop downward by gravity.

The flicker 77 is a thin plate-like member, and scrapes the residues which are collected by the collection roller 74 by coming into contact with a surface of the collection roller 74. The scraped residues drop downward by gravity.

The conveyance screw 75 is disposed directly below the flicker 76. The conveyance screw 75 rotates in a direction indicated by an arrow in the figure to convey the residues, which are scraped by the flickers 76 and 77 from the collection rollers 73 and 74, respectively and dropped, toward one of the end sides in the belt width direction W, and causes a collection tank which is not illustrated to house therein the residues. The cleaning brushes, the collection rollers, and the conveyance screw are each driven to rotate by a motor which is not illustrated.

In the above configuration example, both of the cleaning brushes 71 and 72 each rotate in the direction identical to the rotation direction of the intermediate transfer belt 21. However, the present invention is not limited to this. Depending on the device configuration, only or both of the cleaning brushes 71 and 72 may rotate in a direction reverse to the above rotation direction.

Also, although the cleaning brushes 71 and 72 are used, any cleaning member is applicable with no limitation to the brushes as long as the cleaning member has a function of performing removal operation on residues such as residual toners on the surface of the intermediate transfer belt 21. For example, a cleaning blade may be used. In this case, the cleaning blade should be preferably disposed such that the front head of the cleaning blade is in contact with the surface of the intermediate transfer belt 21 while facing in a direction counter to the belt running direction B. However, the present invention is not limited to this.

The first cleaning subunit 70 is provided for mainly removing residual toners having a comparatively large particle diameter. The first cleaning subunit 70 cannot completely remove paper powders, micro toner powders, external additive particles, and the like, which have a high adhesive force relative to the surface of the intermediate transfer belt 21 because of having a small particle diameter. As a result, more than a little amount of such residues having a high adhesive force slip through the first cleaning subunit 70 and remains on the surface of the intermediate transfer belt 21.

The residues, which have not been completely removed by the first cleaning subunit 70, are cleaned by the second cleaning subunit 80.

(2-2) Configuration of Second Cleaning Subunit

The second cleaning subunit 80 includes a cleaning brush 8. The cleaning brush 8 is disposed in the opening of the housing 90 so as to be positioned on a downstream side relative to the cleaning brush 72 in the belt running direction B, and is elongated in the belt width direction W.

Immediately after the first cleaning subunit 70 performs a removal operation on the residues, the cleaning brush 8 comes into contact with a portion on the surface of the intermediate transfer belt 21 on which the removal operation is performed, so as to remove part of the residues such as paper powders, micro toner powders, and external additive particles, which is slipping through the first cleaning subunit 70 and still remaining on the surface of the intermediate transfer belt 21 even after the removal operation performed by the first cleaning subunit 70.

Here, since residues include a higher amount of paper powders than micro toner powders and external additive particles in the present embodiment, the cleaning brush 8 is hereinafter referred to as a paper powder removal brush 8. Also, since a removal target of the paper powder removal brush 8 is residues that are different from residues, which have been removed by the first cleaning subunit 70, such residues to be removed by the paper powder removal brush 8 are hereinafter referred to also as foreign substances.

Figure 2:
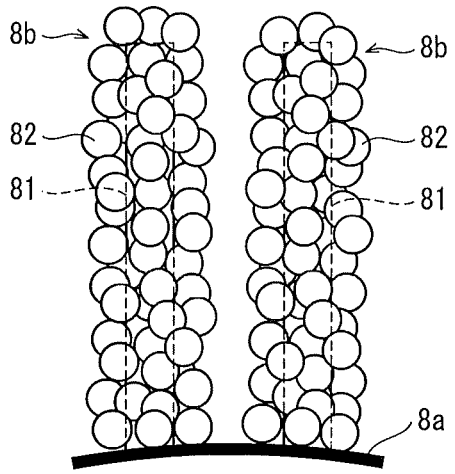
FIG. 2 is an enlarged pattern diagram showing bristles of a brush roller.

The paper powder removal brush 8 includes a metal core 8*a* and fibers that are implanted on an outer circumference of the metal core 8*a*. The fibers are formed from a large number of bristles 8*b*. As shown in an enlarged pattern diagram in FIG. 2, the bristles 8*b* each include an original yarn 81 and a large number of microparticles 82 adhering to and coating a surface of the original yarn 81. Accordingly, the bristles 8*b* each have an uneven surface with minute concave parts and convex parts. The surfaces of the bristles 8*b* has an uneven shape in order to improve a capability of mechanically scraping foreign substances such as paper powders on the surface of the intermediate transfer belt 21 with use of convex portions on the surfaces of the bristles 8*b* with the uneven shape and a capability of absorbing and holding foreign substances such as paper powders into concave portions on the surfaces of the bristles 8*b* with the uneven shape by further increasing a surface area of the bristles 8*b*, compared to bristles of a brush whose surfaces do not have the uneven shape. As such a brush, which has bristles including microparticles adhering to and coating original yarns, the brush disclosed in Japanese Patent Application Publication No. 2012-139488 is applicable for example.

The original yarns 81 are for example made of flexible synthetic fibers such as polyester resin.

The microparticles 82 should preferably be higher in terms of Mohs hardness than calcium carbonate as a principal component of paper powders, which has Mohs hardness of 3. For example, the microparticles 82 may be made of silica, alumina, or the like that have a Mohs hardness of 9. The method disclosed in the above publication application may be used for causing the microparticles 82 to adhere to and coat the surface of original yarns 81. Alternatively, a paper powder removal brush 8 that is manufactured with use of a method different from the method disclosed in the above publication application may be used as long as the paper powder removal brush 8 have bristles 8*b* whose surfaces have the uneven shape due to the microparticles 82 adhering to and coating the original yarns 81.

Here, the microparticles 82 should desirably be made from a material that has insulating characteristics, and charges to a polarity opposite to the polarity of paper powders remaining on the intermediate transfer belt 21 after secondary transfer, due to sliding-contact with the surface of the intermediate transfer belt 21. This is because the bristles 8*b* hold therein the paper powders by the action of an electrostatic force. Note that in the case where the cleaning performance is maintained irrespective of whether or not the electrostatic force acts, the microparticles 82 may be formed from a material that charges to the identical polarity to the polarity of the paper powders, without limiting to the opposite polarity.

The microparticles 82 should desirably have an average particle diameter of for example up to 1 μm that is larger than diameter of paper powders in units of nm and smaller than diameter of toner particles of residual toners, which are transformed to be smaller than the original diameter by grinding or the like (of approximately 1 μm to 2 μm).

The upper limit of 1 μm is desirable for the following two reasons. One is that paper powders and the like in units of mm are easily collected because such paper powders are absorbed into the fibers having the bristles 8*b* whose surfaces has the uneven shape due to the microparticles 82 and because paper powders and the like smaller than the microparticles 82 are absorbed into the concave portions on the bristles 8*b*. The other is that even when the toner particles, which are transformed by grinding, slip through the first cleaning subunit 70, the toner particles are absorbed into fibers constituted from the bristles 8*b*, and also the toner particles are easily prevented from deeply intruding and getting stuck in the fibers and the concave portions.

Also, the microparticles 82 should desirably have a sphericity of for example 0.9 or less in order to increase the capability of removing residues and the adhesion strength relative to the original yarns 81.

The paper powder removal brush 8 is driven to rotate by rotation of the intermediate transfer belt 21, by a friction force between the tip parts of bristles 8*b* and the surface of the intermediate transfer belt 21 that are brought into contact with each other. Here, the paper powder removal brush 8 is rotatably supported by a housing which is not illustrated via a bearing or the like while being driven to rotate, such that little difference occurs in peripheral speed between an outer diameter portion of the paper powder removal brush 8 (the tip parts of the bristles 8*b* that are out of contact with the intermediate transfer belt 21) and the surface of the intermediate transfer belt 21.

This prevents the paper powder removal brush 8 from scratching and abrading the surface of the intermediate transfer belt 21 as much as possible. Specifically, in view of the bristles 8*b* having the surfaces with the uneven shape, in the case where a large difference in peripheral speed is provided between the paper powder removal brush 8 and the intermediate transfer belt 21, the bristles 8*b* often shave the surface of the intermediate transfer belt 21 while apexes of the convex portions on the surfaces of the bristles 8*b* with the uneven shape are brought into sliding-contact with the surface of the intermediate transfer belt 21. If the surface of the intermediate transfer belt 21 is shaved repeatedly many times for a long period, scratches easily occur and abrasion easily increases on the surface of the intermediate transfer belt 21.

The tip parts of the bristles 8*b* of the paper powder removal brush 8 come into contact with the surface of the intermediate transfer belt 21. The tip parts are each for example parts in a range of approximately some mm from the tips in the longitudinal direction of the bristles 8*b*.

In microscopic sense, when the tips of the bristles 8*b* start coming into contact with the surface of the intermediate transfer belt 21, the bristles 8*b* start flexing, and a contact length of the tips that is contact with the surface of the intermediate transfer belt 21 gradually increases. Then, the paper powder removal brush 8 increasingly rotates, and when the bristles 8*b* separate from the surface of the intermediate transfer belt 21, the flexure of the bristles 8*b* is canceled by a restoring force of the bristles 8*b*, and thereby the bristles 8*b* are returned to the original state in which the bristles 8*b* are straight. As a result, the contact length reaches zero.

In other words, the contact length between each of the tip parts of the bristles 8*b* and the surface of the intermediate transfer belt 21 varies every moment from contact to separation therebetween. Hereinafter, the contact length between the tip parts of the bristles 8*b* and the surface of the intermediate transfer belt 21 is referred to as a contact amount.

Variation of the contact amount every moment means that while each of the bristles 8*b* varies from a straight orientation to an inclined orientation and then returns from the inclined orientation to the straight orientation, the peripheral speed of the tip parts also minutely varies every moment in accordance with the variation of the orientation.

The intermediate transfer belt 21 rotates at a constant rotation speed. Accordingly, from when the bristles 8*b* start coming into contact with the surface of the intermediate transfer belt 21 to when the bristles 8*b* separate the surface of the intermediate transfer belt 21, a minute difference in speed occurs between the tip parts of the bristles 8*b* and the surface of the intermediate transfer belt 21. Owing to this minute difference in speed, the bristles 8*b* exhibits a force of scraping foreign substances on the surface of the intermediate transfer belt 21 by shearing the foreign substances. By the action of this scraping force, the foreign substances such as paper powders and micro toner powders on the surface of the intermediate transfer belt 21, which have not been removed by the cleaning brushes 71 and 72, are removed from the surface of the intermediate transfer belt 21. The removed foreign substances are mostly collected into the fibers of the paper powder removal brush 8 having a large number of the bristles 8*b*.

With the configuration in which the paper powder removal brush 8 is driven by the intermediate transfer belt 21 to rotate, it is possible to reduce the difference in peripheral speed therebetween as much as possible. Also, compared to the case where a large difference in peripheral speed is provided therebetween, it is possible to prevent easy occurrence of scratches and abrasion on the surface of the intermediate transfer belt 21 even with use of the bristles 8*b* having the uneven surfaces formed by the microparticles 82.

It is demonstrated by experiment results described below that cleaning performance is improved with the configuration in which the first cleaning subunit 70 and the second cleaning subunit 80 are included.

(3) Experiment Results of Example

The following describes assessment results of the cleaning performance exhibited by the intermediate transfer belt 21 with use of an experimental apparatus created with the settings as described below as an example.

As the intermediate transfer belt 21, a belt was used that is molded by polyimide (PI) and has a volume resistivity of $1\times10^{8}$ Ω·cm. The intermediate transfer belt 21 has a thickness of 80 μm and a peripheral speed of 500 min/sec.

As each of the cleaning brushes 71 and 72, a brush was used which includes straight original yarns made from conductive polyamide synthetic fibers, and have a fineness of 220 T/96 F, a density of 430 KF, and a length 4 mm.

At a contact position with the intermediate transfer belt 21, the cleaning brushes 71 and 72 were each set to rotate in an inverse (counter) direction to the belt running direction B. The respective outer diameter portions of the cleaning brushes 71 and 72 (the tip parts of the bristles 8*b* which are out of contact with the intermediate transfer belt 21) were each set to have a peripheral speed of 500 mm/sec. The cleaning brushes 71 and 72 were each disposed so as to have a contact amount (the maximum value) relative to the intermediate transfer belt 21 of 1 mm, and were each set to have an electrical resistance of $1\times10^{8}$ Ω·cm.

A bias voltage of −200 V was applied to the cleaning brush 71 by constant voltage control, which is positioned upstream in the belt running direction B, whereas a bias voltage of +200 V was applied to the cleaning brush 72 by constant voltage control, which is positioned downstream in the belt running direction B.

On the other hand, as the paper powder removal brush 8, a brush was used which has bristles 8*b* including straight original yarns 81 and microparticles 82*b* adhering to and coating the original yarns 81. Here, the straight original yarns 81 are made from polyamide synthetic fibers that have a fineness of 220 T/96 F, a density of 430 KF, and a length 5 mm, and the microparticles 82 are made from silica particles that have an average particle diameter of 0.5 μm and an average sphericity of 0.75. The paper powder removal brush 8 was set to have an electrical resistance of $1\times10^{10}$ Ω·cm.

The paper powder removal brush 8 was disposed so as to have a contact amount (the maximum value) of 1 mm relative to the intermediate transfer belt 21. The paper powder removal brush 8 was configured to rotatably supported so as to be driven to rotate by the intermediate transfer belt 21 by a friction force between the paper powder removal brush 8 and the intermediate transfer belt 21. Note that the potential condition of the paper powder removal brush 8 was grounding, specifically, the metal core 8*a* of the paper powder removal brush 8 was grounded.

Figure 3:
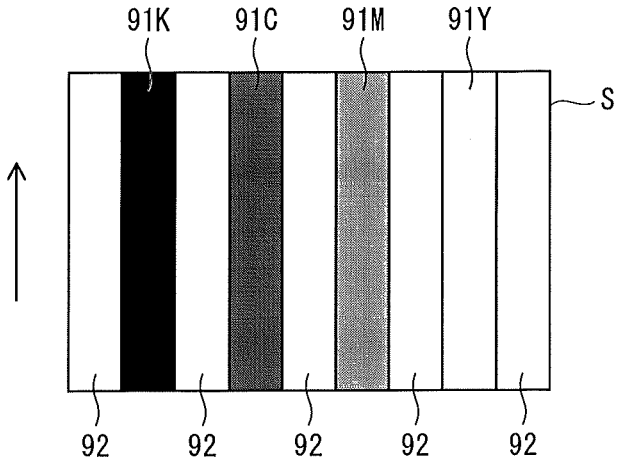
FIG. 3 shows an example of a test chart of respective longitudinal and zonal solid patterns of Y, M, C, and K colors.

In the experimental apparatus set as described above, a durability test was conducted in which a test chart of respective longitudinal and zonal solid patterns of Y, M, C, and K colors such as shown in FIG. 3 was continuously printed on, piece by piece, the total of one million sheets, specifically, A4-sized color papers of 90 g/m$^2$ manufactured by Mondi.

Here, a direction indicated by an arrow in FIG. 3 is the conveyance direction of the sheets S, and coincides with the belt running direction B of the secondary transfer position 291, and is defined as a vertical direction. On each of the sheets S, longitudinal and zonal solid patterns 91Y, 91C, 91M, and 91K were formed at intervals in a direction perpendicular to the conveyance direction of the sheet S, and parts where the longitudinal and zonal solid patterns 91Y, 91C, 91M, and 91K are not formed are image non-formation regions 92.

When the sheet S passes through the secondary transfer position 291, the image non-formation regions 92 on the sheet S are brought into direct contact with the surface of the intermediate transfer belt 21. At this time, paper powders existing on the image non-formation regions 92 are deposited on the surface of the intermediate transfer belt 21. If the deposited paper powders are not removed, as the number of printed sheets increases, paper powders are increasingly deposited on and stick to the surface of the intermediate transfer belt 21. This causes occurrence of filming on the surface of the intermediate transfer belt 21.

In the case where filming occurs on the surface of the intermediate transfer belt 21, volume resistance increases in a region where the filming occurs more than in a region where no filming occurs. Accordingly, regions differing in volume resistance are mixed on the surface of the intermediate transfer belt 21, and this causes difference in transfer current between the regions differing in volume resistance. As a result, images with non-uniform density are easily formed.

Figure 4:
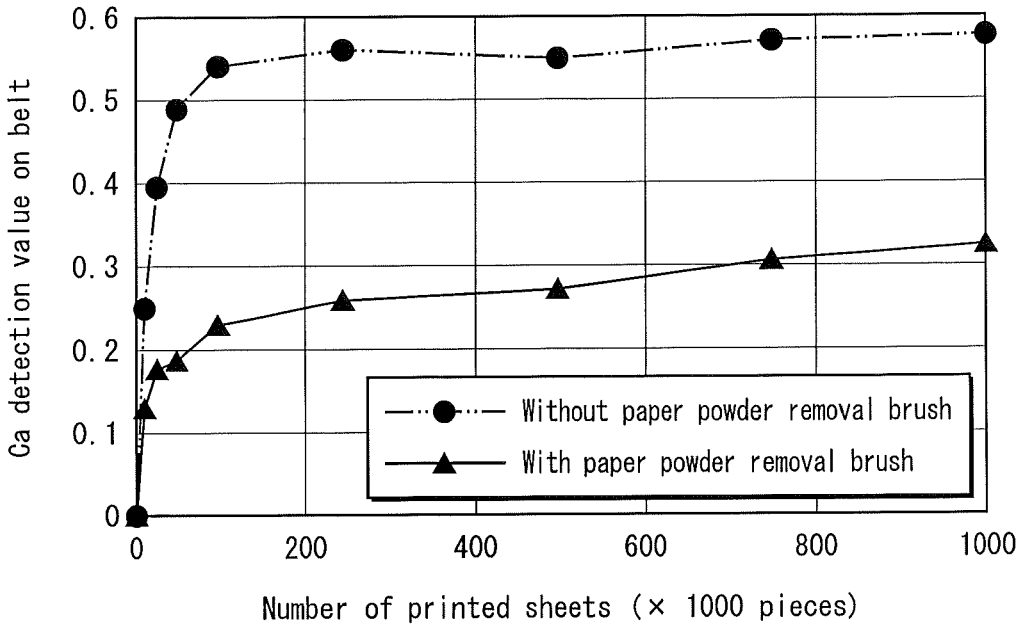
FIG. 4 shows detection values of contained amount of calcium carbonate that is deposited on a surface of an intermediate transfer belt in a durability test conducted with use of an experimental apparatus.

FIG. 4 shows measurement results in the above durability test, representing an amount of paper powders deposited on parts on the surface of the intermediate transfer belt 21 which correspond to image non-formation regions 92, where the horizontal axis represents the number of printed sheets, and the vertical axis represents detection value of a contained amount of calcium carbonate that is a principal component of paper powders (Ca detection value). The number of printed sheets is expressed in units of 1000 pieces. Hereinafter, the number of printed sheets is expressed in unit of K. For example, the number of one hundred thousand printed sheets is expressed by 100 K, and the number of one million printed sheets is expressed by 1000 K.

The contained amount of calcium carbonate was detected with use of the wavelength dispersive X-Ray fluorescence spectrometer manufactured by Shimadzu Corporation. A higher Ca detection value, which indicates the contained amount of calcium carbonate, means a higher amount of paper powders.

FIG. 4 also shows measurement results with respect to an experimental apparatus having a configuration in which the paper powder removal brush 8 is not disposed (a comparison example 1) for comparison. A graph in solid line represents the measurement results of the example, whereas a graph in two-dot chain line represents the measurement results of the comparison 1.

As shown in FIG. 4, the comparison 1 shows that the Ca detection value exceeds 0.5 before the number of printed sheets reaches 100 K. In the experimental apparatus, the upper limit of Ca detection value is determined in advance within a range where non-uniform density in formed images is acceptable. Specifically, with respect to the case where screen processing in image forming operations such as tone correction processing by a dither method is performed, the upper limit of Ca detection value is determined to 0.5. With respect to the case where no screen processing is performed, the upper limit of Ca detection value is determined to 0.35. Based on these upper limits, the comparison 1 demonstrates that the non-uniform density exceeds the acceptable range at an early stage, namely, at 100 K. This makes users to recognize image deterioration.

Figure 5:
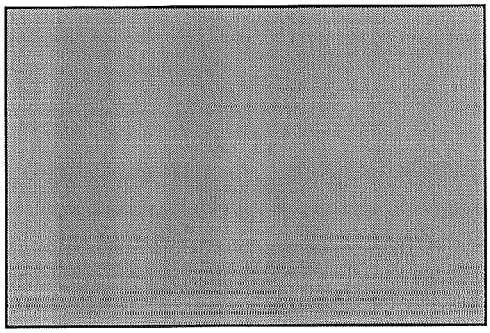
FIG. 5 shows an example of a halftone image with uniform density in section (a) and an example of an image with non-uniform density in section (b)
Figure 5:
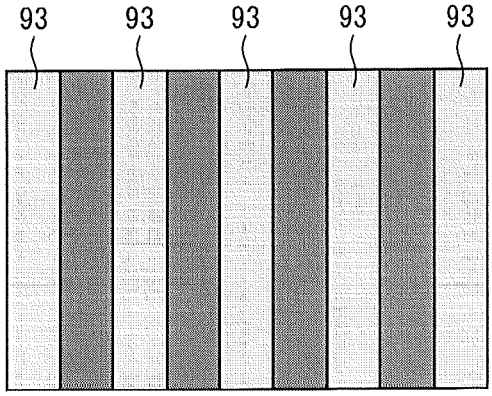

FIG. 5 is a pattern diagram showing a situation in which in the case where a halftone image with the entirely uniform density is printed on a sheet S after the above durability test, density of a formed image is not uniform due to filming that occurs on the surface of the intermediate transfer belt 21. In FIG. 5, section (a) shows a halftone image with uniform density, whereas section (b) shows an image with non-uniform density. In section (b) of FIG. 5, regions 93 each represent an image part formed in a range where filming occurs, and are lower in density than other regions.

As described above, the volume resistance increases in a region on the surface of the intermediate transfer belt 21 where filming occurs. Accordingly, a transfer current decreases more in the region where filming occurs than in a region on the surface of the intermediate transfer belt 21 where no filming occurs. As a result, in the region where filming occurs, a transfer rate of toner images onto the sheet S transferred by the intermediate transfer belt 21 decreases, and thereby the density of the toner image formed on the sheet S is lower than the original density.

According to the example (the graph in solid line) as shown in FIG. 4 compared to this, until the number of printed sheets reaches 1000 K, the Ca detection value is suppressed to 0.35 or lower. Accordingly, non-uniform density in a formed image falls within the acceptable range even if the non-uniform density occurs. This demonstrates that it is possible to prevent occurrence of clearly non-uniform density such as shown in section (b) in FIG. 5, and thereby to maintain an excellent image quality for a considerably long period until the number of printed sheets reaches 1000 K.

Figure 6:
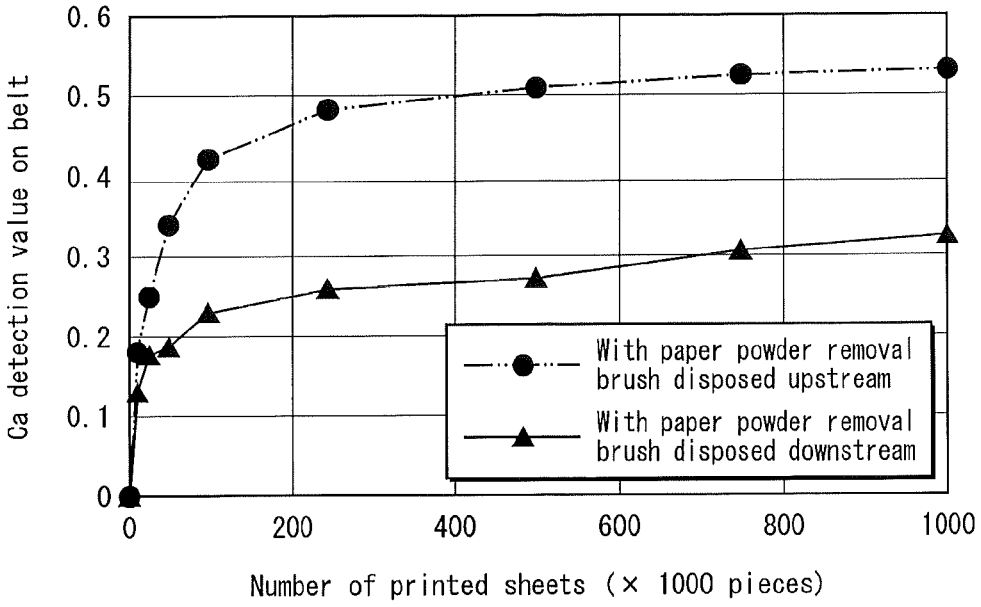
FIG. 6 shows detection values of contained amount of calcium carbonate that is deposited on the surface of intermediate transfer belt in a durability test conducted with respect to each of a configuration in which a paper powder removal brush is disposed on an upstream side relative to a cleaning brush in a belt running direction and a configuration in which the paper powder removal brush is disposed on a downstream side relative to the cleaning brush in the belt running direction.

Furthermore, FIG. 6 shows Ca detection values that were measured in the case where a durability test was conducted under the above conditions with use of an experimental apparatus (a comparison example 2) having a configuration in which the paper powder removal brush 8 is disposed on the upstream side relative to the cleaning brush 71 in the belt running direction B.

In FIG. 6, a graph in solid line represents the measurement results of the example, whereas a graph in two-dot chain line represents measurement results of the comparison example 2. As shown in the figure, the comparison example 2 is considerably higher than the example in terms of Ca detection value. This is considered to be caused for the following reason.

Specifically, the paper powder removal brush 8 is disposed on the upstream side relative to the cleaning brush 71 in the belt running direction B. Accordingly, much of residual toners remaining after secondary transfer is deposited on the bristles 8*b* of the paper powder removal brush 8, and the microparticles 82, which adhere to and coat the original yarns 81, are covered with particles of residual toners. This early decreases the force of scraping paper powders and the like exhibited by the microparticles 82 forming the uneven shape. Also, the cleaning brush 71, which is disposed downstream, cannot remove residues in units of nanometers such as paper powders because of being a normal brush having a configuration in which the microparticles 82 do not adhere to and coat surfaces of original yarns.

The measurement results in FIG. 6 demonstrate that the paper powder removal brush 8 and the cleaning brush 71 need to have a positional relation in which the paper powder removal brush 8 is disposed on the downstream side relative to the cleaning brush 71 in the belt running direction B.

With the configuration in the present embodiment as described above, it is possible, firstly, to clean residues (mainly, residual toners) remaining on the intermediate transfer belt 21 after secondary transfer by using the cleaning brushes 71 and 72. Subsequently, it is possible to clean foreign substances, which have a smaller size than the residual toners and have not been removed by the cleaning brushes 71 and 72, such as paper powders, micro toner powders, and external additive particles, with use of the paper powder removal brush 8, which is disposed on the downstream side relative to the cleaning brushes 71 and 72 in the belt running direction B and has the bristles 8*b* including the microparticles 82 adhering to and coating the original yarns 81.

Compared to bristles of a brush whose surfaces do not have the uneven shape, the bristles 8*b* whose surfaces have the uneven shape exhibit a high capability of mechanically scarping foreign substances on the intermediate transfer belt 21 such as paper powders with use of convex portions on the surfaces of the bristles 8*b* with the uneven shape and a high capability of absorbing and collecting the foreign substances such as paper powders owing to a further increased surface area of the bristles 8*b*.

Furthermore, since the paper powder removal brush 8 is disposed on the downstream side relative to the cleaning brushes 71 and 72 in the belt running direction B, it is possible to prevent a phenomenon that much of residual toners on the intermediate transfer belt 21 is deposited on and stick to the bristles 8*b* of the paper powder removal brush 8.

This allows the bristles 8*b* with the uneven shape to continuously exhibit the effects of removing paper powders, external additive particles, and the like for a long period, and thereby to prevent early occurrence of filming. As a result, the cleaning performance is further improved.

Embodiment 2

In the above Embodiment 1, the configuration example has been explained in which the position of the paper powder removal brush 8 is not displaced (fixed) in a perspective direction of the paper powder removal brush 8 relative to the intermediate transfer belt 21, that is, a direction relatively away from each other and a direction relatively toward each other. In the present Embodiment 2 compared to this, the position of the paper powder removal brush 8 is displaceable and control is executed to increase the contact amount of the paper powder removal brush 8 relative to the intermediate transfer belt 21 based on a predetermined condition such as the cumulative number of printed sheets. This is a difference between Embodiments 1 and 2. Hereinafter, explanation of the same configuration as that in Embodiment 1 is omitted and the same compositional elements as those in Embodiment 1 have the same numerical references in order to avoid duplicate explanation.

(1) Configuration of Displacement Mechanism for Paper Powder Removal Brush

Figure 7:
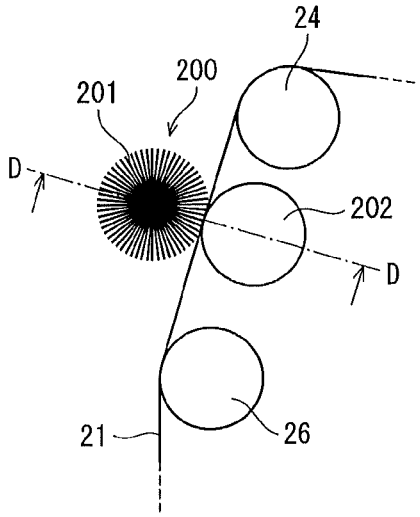
FIG. 7 shows a configuration example of a displacement mechanism for a paper powder removal brush relating to Embodiment 2.
Figure 8:
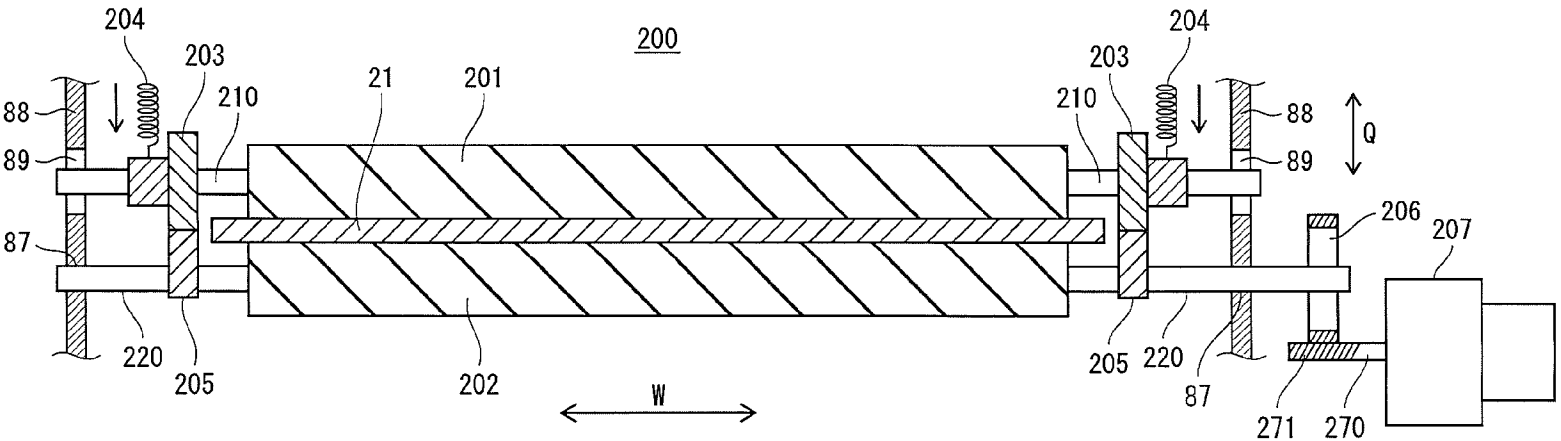
FIG. 8 is a cross-sectional view showing the displacement mechanism, taken along a line D-D in FIG. 7.

FIG. 7 shows a configuration example of a displacement mechanism for a paper powder removal brush relating to Embodiment 2. FIG. 8 is a cross-sectional view showing the displacement mechanism, taken along a line D-D in FIG. 7.

As shown in FIG. 7 and FIG. 8, a displacement mechanism 200 includes a paper powder removal brush 201, a backup roller 202, positioning rollers 203, compression springs 204, eccentric cams 205, a gear 206, and a motor 207.

The paper powder removal brush 201 is disposed on the side of a front surface of the intermediate transfer belt 21, whereas the backup roller 202 is disposed on the side of a reverse surface of the intermediate transfer belt 21. The paper powder removal brush 201 and the backup roller 202 are disposed facing each other with the intermediate transfer belt 21 therebetween. Here, the paper powder removal brush 201 and a rotary shaft 210 thereof rotate integrally, whereas the backup roller 202 is rotatable relative to a rotary shaft 220 thereof.

The positioning rollers 203 are fit onto respective both end sides of the rotary shaft 210 of the paper powder removal brush 201 in the belt width direction W. The positioning rollers 203 are identical to each other in terms of shape and size, and are each formed from a circular plate-like member having a certain radius from a shaft center of the rotary shaft 210. The positioning rollers 203 are each rotatable relative to the rotary shaft 210.

The eccentric cams 205 are fit onto respective parts on the both end sides of the rotary shaft 220 of the backup roller 202 in the belt width direction W. The eccentric cams 205 are identical to each other in terms of disc shape and size, and are fixed to the rotary shaft 220.

On each of the both end sides in the belt width direction W, the respective positions of the positioning roller 203 and the eccentric cam 205 in the belt width direction W are determined in advance such that a circumferential surface of the positioning roller 203 and a circumferential surface of the eccentric cam 205 are brought into contact with each other.

The both end parts of the rotary shaft 210 of the paper powder removal brush 201 are each engaged with an elongated hole 89 provided in a device housing 88. The elongated holes 89 are each elongated along a belt perspective direction of the paper powder removal brush 201 relative to the intermediate transfer belt 21, that is, a direction relatively away from each other and a direction relatively toward each other (a direction indicated by an arrow Q). Owing to engagement of the rotary shaft 210 with the elongated holes 89, the paper powder removal brush 201 is supported so as to be rotatable and slidable in the belt perspective direction by a length of the elongated holes 89.

The both end parts of the rotary shaft 220 of the backup roller 202 are each rotatably supported by a hole 87 provided in the device housing 88.

The compression springs 204 are each provided so as to correspond to one of the positioning rollers 203, and each apply a pressing force to the corresponding positioning roller 203 to be applied to a corresponding one of the eccentric cams 205. Owing to the pressing force applied by the compression springs 204, the positioning rollers 203 are always pressed by the respective eccentric cams 205.

The gear 206 is a worm wheel, and is fit onto and fixed to one of the ends of the rotary shaft 220 of the backup roller 202. The gear 206 meshes with a worm 271 provided in a rotary driving shaft 270 of the motor 207, and thereby configures a worm gear.

According to this configuration, when the motor 207 is driven, a driving force thereof is transmitted to each of the eccentric cams 205 via the rotary driving shaft 270, the gear 206, and the rotary shaft 220. The eccentric cams 205 each rotate by an angle corresponding to a rotational angle of the rotary driving shaft 270 of the motor 207. When the eccentric cams 205 rotate, the respective positions of the backup roller 202 and the intermediate transfer belt 21 do not vary in the direction indicated by the arrow Q, whereas a space of each of the positioning rollers 203 relative to the backup roller 202 varies. This variation of the space means that the position of the paper powder removal brush 201 varies in the belt perspective direction (the direction indicated by the arrow Q).

The closer to the intermediate transfer belt 21 the paper powder removal brush 201 is, the longer parts of the bristles 8*b* that are in contact with the surface of the intermediate transfer belt 21 are, that is, the larger a contact amount of the paper powder removal brush 201 is.

Accordingly, it is possible to determine a rotational angle Y that is necessary for increasing the current contact amount of the paper powder removal brush 201 relative to the intermediate transfer belt 21 (hereinafter, referred to as a brush contact amount) by an amount X, by obtaining in advance a relationship between the rotational angle of the motor 207 and the brush contact amount by experiments or the like, such as a relationship in which the brush contact amount at a rotational angle of 5° relative to the reference is X1, the brush contact amount at a rotational angle of 10° relative to the reference is X2 (>X1), and the brush contact amount at a rotational angle of 15° relative to the reference is X3 (>X2).

Note that, after the motor 207 stops, a rotational force in a direction reverse to a rotational direction of the motor 207 before stopping is transmitted from the eccentric cams 205 to the gear 206 via the rotary shaft 220 by the action of a pressing force imposed by the compression springs 204. However, since the gear 206 configures the worm gear, neither the gear 206 nor the eccentric cams 205 rotate reversely.

Such a displacement mechanism is used for setting a variable brush contact amount in order to further reduce an amount of foreign substances such as paper powders that are deposited on the intermediate transfer belt 21 to further improve an effect of preventing occurrence of filming.

In other words, according to the configuration in which the paper powder removal brush 201 is not displaced, only the tip parts of the bristles 8*b* of the paper powder removal brush 201 are in contact with the surface of the intermediate transfer belt 21 for a long period. In this case, according to the configuration in which paper powders and the like tend to be gradually deposited on and stick to the microparticles 82, which coat the tips of the bristles 8*b*, the scraping capability exhibited by the microparticles 82 gradually deteriorates compared to in the initial state (the new state). This gradually increases an amount of foreign substances such as paper powders which are deposited on the intermediate transfer belt 21, and as a result filming more easily occurs as towards the end of the operating life of the paper powder removal brush 201.

This deterioration of the scraping capability is due to that only the tip parts of the bristles 8*b* are in contact with the surface of the intermediate transfer belt 21 for a long period.

In view of this, when the scraping capability deteriorates to a certain degree, the brush contact amount of the paper powder removal brush 201 is increased such that parts of the bristles 8*b*, which are closer to the base from the tips and coated by the microparticles to which much amount of paper powders and the like have not yet stuck, may come into contact with the surface of the intermediate transfer belt 21, in addition to the tip parts. This improves the scraping capability compared to that immediately before the increase of the brush contact amount, and thereby prevents continuous deterioration of the scraping capability until the operating life of the paper powder removal brush 201 ends.

In the present embodiment in view of this, experiments or the like are performed in advance so as to obtain a degree to which and a condition under which the scraping capability deteriorates. Then, when the condition is satisfied, control is executed to increase the brush contact amount by a predetermined amount thereby to further reduce the amount of foreign substances such as paper powders deposited on the surface of the intermediate transfer belt 21. In the present embodiment, the cumulative number of printed sheets is used as a predetermined condition.

Figure 9:
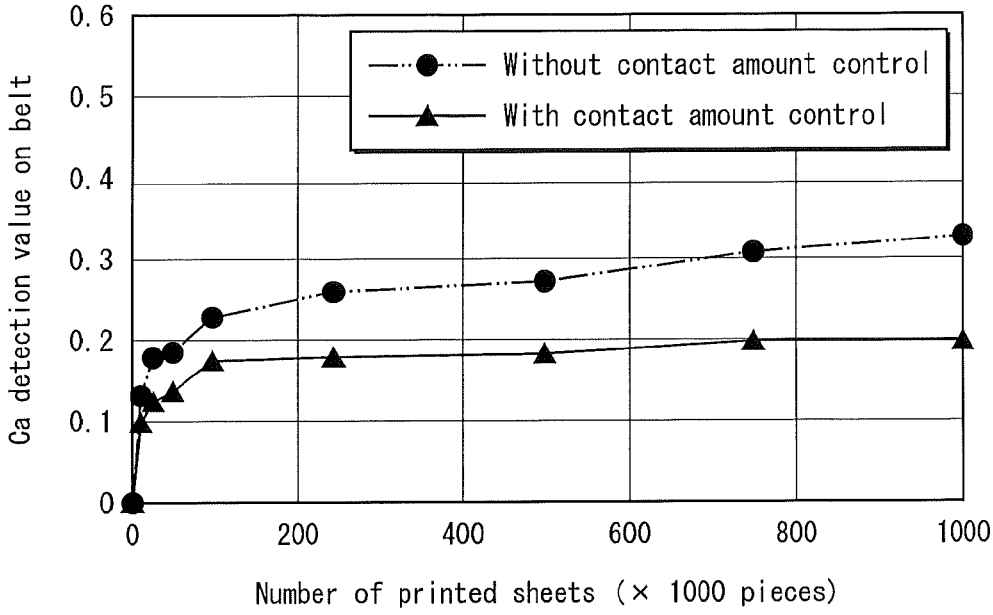
FIG. 9 shows detection values of contained amount of calcium carbonate that is deposited on the surface of intermediate transfer belt in a durability test conducted with respect to each of a configuration in which brush contact amount increase control is implemented in the experimental apparatus and a configuration in which the brush contact amount increase control is not implemented in the experimental apparatus.

FIG. 9 shows Ca detection values indicating a contained amount of calcium carbonate that is deposited on the surface of the intermediate transfer belt 21 in a durability test which was conducted under the same condition as the above durability test with respect to each of a configuration in which the brush contact amount increase control is implemented in the above experimental apparatus and a configuration in which the brush contact amount increase control is not implemented in the above experimental apparatus.

With respect to both the configurations, the brush contact amount was 1 mm at the start time of the durability test. With respect to the configuration in which the brush contact amount increase control is implemented, control was executed to increase the brush contact amount by 0.1 mm each time the number of printed sheets reaches 100 K.

As shown in the figure, with respect to the configuration in which the brush contact amount increase control is not implemented (graph in two-dot chain line), when the number of printed sheets reaches 1000 K, the Ca detection value is slightly smaller than 0.35 which is the upper limit. This value falls within a range according to which users do not recognize non-uniform density caused by filming such as described above, However, this value is close to the upper limit, and a tendency was observed that the Ca detection value increases though slowly.

Compared to this, with respect to the configuration in which the brush contact amount increase control is implemented (graph in solid line), when the number of printed sheets reaches 1000 K, the Ca detection value was 0.2 that is considerably smaller than 0.35 which is the upper limit. Also, no increase tendency was observed and the Ca detection value was settled to a constant value. This demonstrates that it is possible to further reduce the amount of foreign substances such as paper powders deposited on the surface of the intermediate transfer belt 21 by implementing the brush contact amount increase control.

The smaller the amount of paper powders and the like deposited on the surface of the intermediate transfer belt 21 is, The slower the growth speed of filming is and the later the density becomes un-uniform. In view of this, it is especially desirable to apply the brush contact amount increase control to products for use in for example a so-called production print field in which a high image quality that is stable for a long period is required.

In the above configuration, the brush contact amount is variably controlled with use of the cams and the worm gear. Alternatively, any movement mechanism may be used as long as the paper powder removal brush 201 and the intermediate transfer belt 21 are movable in a direction relatively away from each other and a direction relatively toward each other (the perspective direction). For example, the following displacement mechanism with use of a so called feed screw mechanism is adoptable in which one of the paper powder removal brush 201 and the intermediate transfer belt 21 is movable by a distance corresponding to a rotation amount of screws in a direction in which the one comes close to the other.

(2) Configuration of Control Unit

Figure 10:
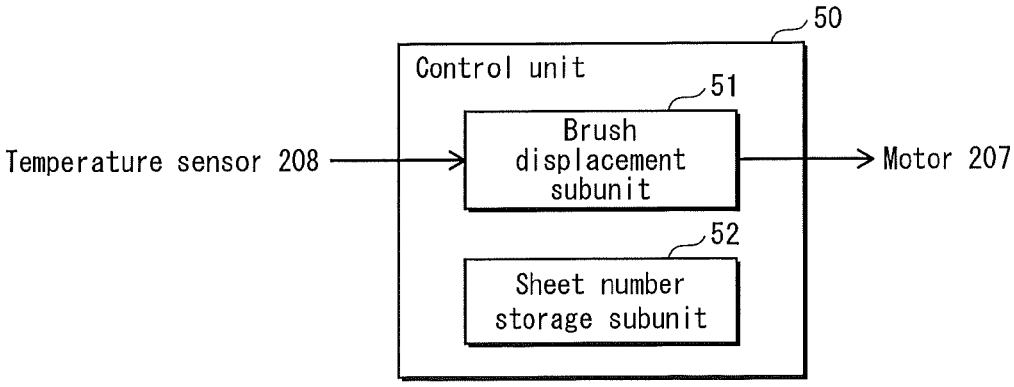
FIG. 10 shows a configuration of a control unit relating to Embodiment 2.

FIG. 10 shows a configuration of a control unit 50 relating to Embodiment 2.

As shown in the figure, the control unit 50 includes a brush displacement subunit 51 and a sheet number storage subunit 52.

The brush displacement subunit 51 controls the motor 207 to control the brush contact amount of the paper powder removal brush 201 relative to the surface of the intermediate transfer belt 21.

The sheet number storage subunit 52 is a non-volatile storage unit that stores therein data of a cumulative number P of printed sheets. The cumulative number P of printed sheets indicates a cumulative number (total number) of pieces of sheets S printed in all the past print jobs which have been executed to the current time. Each time a print on one piece of sheet S completes, the cumulative number P of printed sheets is updated by the brush displacement subunit 51, as described later.

Figure 11:
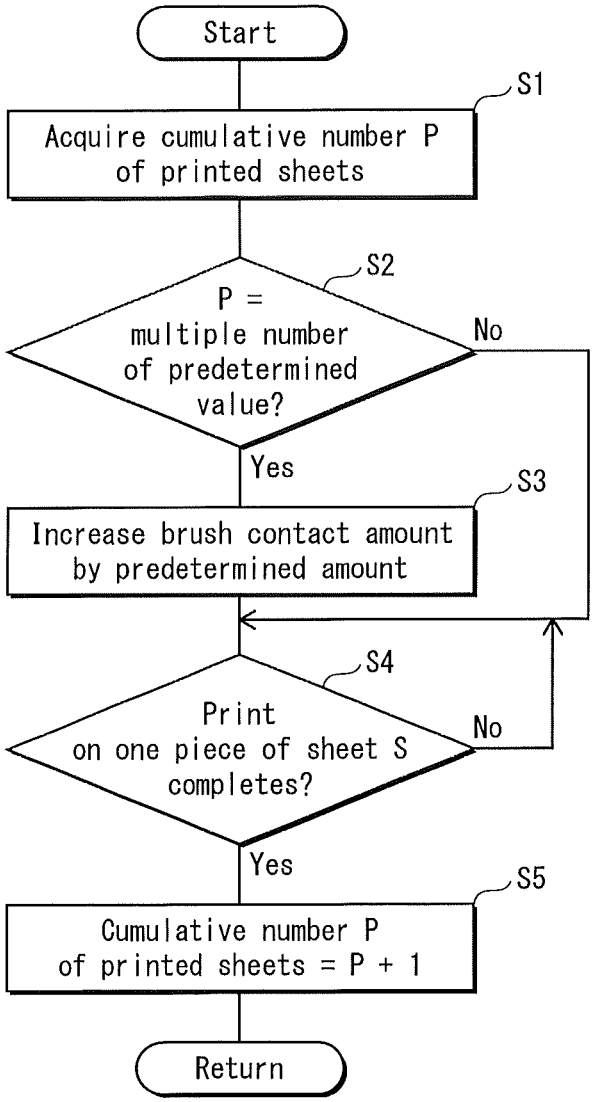
FIG. 11 is a flow chart showing processing of brush contact amount increase control executed by a brush displacement subunit included in a control unit.

(3) Processing of Brush Contact Amount Increase Control of Paper Powder Removal Brush FIG. 11 is a flow chart showing processing of brush contact amount increase control executed by the brush displacement subunit 51. This processing is performed by being called by a main routine which is not illustrated each time a print is executed on one piece of sheet S.

As shown in the figure, the brush displacement subunit 51 acquires the cumulative number P of printed sheets (Step S1). The cumulative number P of printed sheets is acquired by reading data of the cumulative number P of printed sheets that is currently stored in the sheet number storage subunit 52.

The brush displacement subunit 51 judges whether or not the acquired cumulative number P of printed sheets is equal to any of numerical values each expressed by a multiple number of a predetermined value (Step S2). The predetermined value is a predetermined constant value, and is for example 100 K. It is judged as to whether or not the cumulative number P of printed sheets is equal to any of multiple numbers of 100 K, namely, 100 K, 200 K, 300 K, . . . .

When judging that the cumulative number P of printed sheets is equal to any of the multiple numbers of the predetermined value (Step S2: Yes), the brush displacement subunit 51 increases the current brush contact amount by a predetermined amount, for example by 0.1 mm (Step S3), and then proceeds to Step S4. The brush contact amount is increased by rotating the motor 207 by a rotational angle, which is necessary for increasing the brush contact amount by the predetermined amount to reduce the current distance between the paper powder removal brush 201 and the intermediate transfer belt 21 by distance corresponding to the predetermined increase amount.

When judging that the cumulative number P of printed sheets is not equal to any of the multiple numbers of the predetermined value (Step S2: No), the brush displacement subunit 51 skips (does not execute) Step S3, and then proceeds to Step S4.

In Step S4, the brush displacement subunit 51 judges whether or not a print on one piece of sheet S completes. When judging that the print on one piece of sheet S completes (Step S4: Yes), the brush displacement subunit 51 updates the sheet number storage subunit 52 with a value obtained by incrementing the current cumulative number P of printed sheets by 1 as a new cumulative number P of printed sheets (Step S5), and then the flow returns.

Accordingly, each time the cumulative number P of printed sheets reaches a numerical value that is expressed by any of the multiple numbers of the predetermined value, the brush contact amount increases by the predetermined increase amount. This allows the paper powder removal brush 201 to continuously exhibit the effects of removing foreign substances such as paper powders for a long period.

The configuration example has been explained above in which the judgment is made as to whether or not an execution timing of the brush contact amount increase control comes in accordance with the cumulative number P of printed sheets. However, the present invention is not limited to this. Alternatively, a condition may be used for judging whether or not a predetermined timing suitable for increasing the current brush contact amount comes.

For example, the judgment may be made in accordance with a cumulative print execution period indicating a cumulative execution period of print jobs. Further alternatively, the judgment may be made for each time a cumulative belt driving period reaches a predetermined value. The cumulative belt driving period indicates a cumulative rotation period or a cumulative number of rotations of the intermediate transfer belt 21. Yet alternatively, the judgment may be made each time a constant period irrespective of the operation of printer, such as one month, elapses. Still alternatively, the judgment may be made based on any combination of two or more of the above conditions.

(4) Modification 1 of Brush Contact Amount Increase Control

In the above Embodiment 2, the configuration example has been explained in which each time increase control is executed, the brush contact amount is increased by the predetermined constant amount. However, the increase amount is not limited to the constant amount. Alternatively, the increase amount may be varied in accordance with temperature inside the printer, specifically temperature of the intermediate transfer belt 21 or an ambient temperature of the intermediate transfer belt 21.

In the case where low-temperature fusing toners are used for example for the printer, micro toner powders and external additive particles of the low-temperature fusing toners, and the like fuse and accordingly easily stick to the intermediate transfer belt 21 together with paper powders at a high temperature inside the printer compared with at a low temperature inside the printer. This means that the amount of micro toner powders and the like sticking to the surface of the intermediate transfer belt 21 increases and the growth speed of filming increases at a high temperature inside the printer compared to a low temperature inside the printer.

In order to suppress the increase of the growth speed of the filming at a high temperature inside the printer, the paper powder removal brush 201 should have an increased capability of removing micro toner powders and the like compared to at a low temperature inside the printer. In order to increase the capability of removing micro toner powders and the like, the brush contact amount should be further increased as described above. However, if the brush contact amount is excessively increased, the bristles 8*b* of the paper powder removal brush 201 acts an excessively large scraping force on the surface of the intermediate transfer belt 21, and as a result, the surface of the intermediate transfer belt 21 is easily abraded by the bristles 8*b*.

In view of this, in the brush contact amount increase control, when the temperature inside the printer falls within a temperature range lower than the high temperature range (non-high temperature range), the increase amount of the brush contact amount is set to a reference value (0.1 mm in the above example). On the other hand, when the temperature inside the printer falls within the high temperature range, the increase amount of the brush contact amount is set to a value (0.15 mm for example) larger than the reference value. In this way, it is possible to execute the brush contact amount increase control suitable for the temperature inside the printer.

The temperature inside the printer is detected by a temperature sensor 208 shown in FIG. 10, and the detected value of the temperature is transmitted to the brush displacement subunit 51. The temperature sensor 208 is disposed for example in a peripheral space of the intermediate transfer belt 21.

Figure 12:
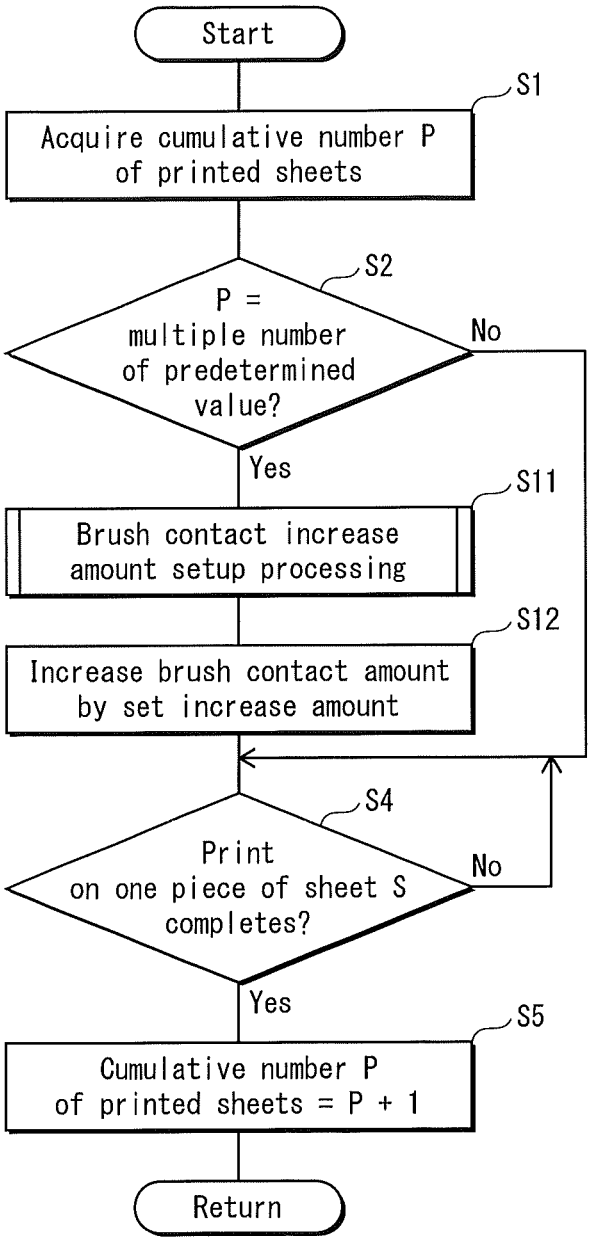
FIG. 12 is a flow chart showing processing of varying an increase amount of a brush contact amount in accordance with temperature inside the printer.

FIG. 12 is a flow chart showing processing of varying the increase amount of the brush contact amount in accordance with the temperature inside the printer. FIG. 12 includes Steps S11 and S12 instead of Step S3 in FIG. 11. This is a different point from FIG. 11. The following explanation focuses on this different point.

When judging that the cumulative number P of printed sheets is equal to any of the multiple numbers of the predetermined value (Step S2: Yes), the brush displacement subunit 51 performs setup processing of setting the increase amount of the brush contact amount (hereinafter, referred to as brush contact increase amount setup processing) (Step S11).

Figure 13:
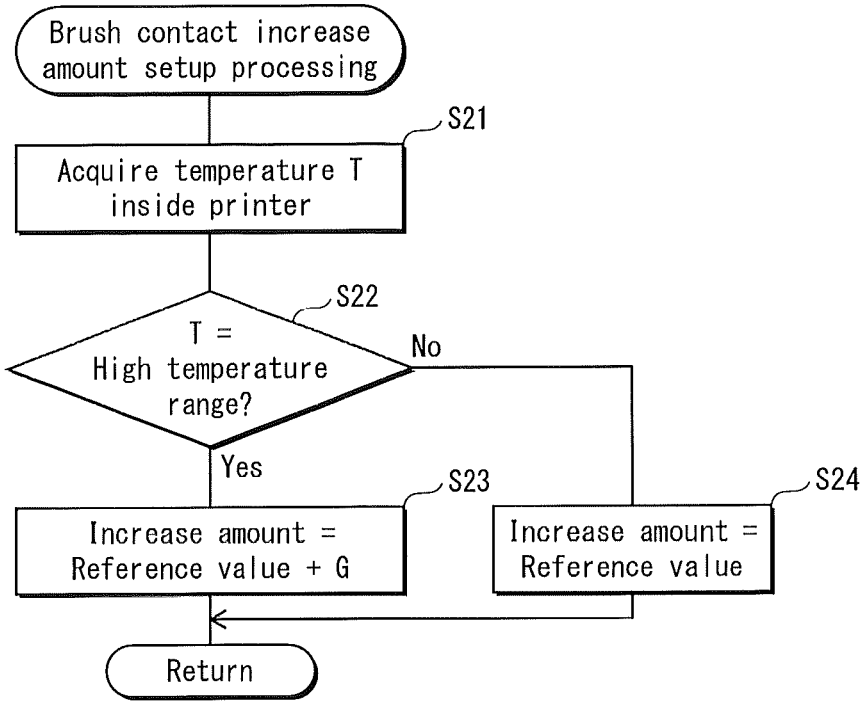
FIG. 13 is a flow chart showing a subroutine of brush contact increase amount setup processing.

FIG. 13 is a flow chart showing a subroutine of the brush contact increase amount setup processing.

As shown in the figure, the brush displacement subunit 51 acquires a current temperature T inside the printer (Step S21). The temperature T is acquired by receiving a value detected by the temperature sensor 208.

The brush displacement subunit 51 judges whether or not the temperature T inside the printer falls within a high temperature range (Step S22). This high temperature range is a range of a predetermined temperature or higher, such as a range of a temperature of 30 degrees C. or higher. The high temperature range is determined in advance by experiments or the like. It is assumed that when the temperature T inside the printer falls within the high temperature range, the increase amount of the brush contact amount needs to be set to a value higher than the reference value.

When judging that the temperature T inside the printer does not fall within the high temperature range, that is, falls in a non-high temperature range (Step S22: No), the brush displacement subunit 51 sets the increase amount of the brush contact amount to the reference value (0.1 mm in the above example) (Step S24). Then, the flow returns.

When judging that the temperature T inside the printer falls within the high temperature range (Step S22: Yes), the brush displacement subunit 51 sets the increase amount of the brush contact amount to a value resulting from adding a positive correction value G (0.05 mm for example) to the reference value, that is, sets the increase amount to a value higher than the reference value (Step S23). Then, the flow returns.

Returning to Step S12 in FIG. 12, the brush displacement subunit 51 increases the brush contact amount by the increase amount set in Step S11. The brush contact amount is increased by rotating the motor 207 by a rotational angle, which is necessary for increasing the brush contact amount by the set increases amount.

Accordingly, each time the brush contact amount increase control is executed, an increase amount suitable for each temperature T inside the printer is set. This makes it possible to execute further appropriate brush contact amount increase control. Note that the temperature inside the printer is not limited to the current temperature, and alternatively may be for example a historical average temperature inside the printer. Specifically, the average temperature inside the printer may be an average value of the temperature inside the printer with respect to all print jobs which have been executed from when an immediately previous brush contact amount increase control completes to the current time.

In the above explanation, the example of increase control has been provided in which the increase amount of the brush contact amount is varied in accordance with whether or not the temperature T inside the printer falls within the high temperature range. However, the present invention is not limited to this. Alternatively, the following control may be configured for example. Specifically, three or more different temperature ranges are each finely associated in advance with a different increase amount of the brush contact amount, and an increase amount of the brush contact amount is set, which is associated with a temperature range within which a detected value of the temperature T inside the printer falls.

Also, the condition for judging whether or not to execute brush contact amount increase control is not limited to the temperature inside the printer. Alternatively, the condition may be for example a coverage rate of toner images, a primary transfer bias, or the like.

<Coverage Rate of Toner Images>

Coverage rate of toner images is a numerical value indicating a ratio, in percentage, of a cumulative area where toner images are formed to the entire area of one piece of sheet S. A lower coverage rate indicates that one piece of sheet S has, in the entire area in the sheet S, smaller regions where toner images are formed, that is, larger image non-formation regions.

One piece of sheet S, which has larger image non-formation regions, has larger regions that are brought into direct contact with the surface of the intermediate transfer belt 21 while passing through the secondary transfer position 291. Accordingly, in the case where the sheet S has larger image non-formation regions, a larger amount of paper powders must be deposited on the surface of the intermediate transfer belt 21 than in the case where the sheet S has smaller non-formation regions. As the amount of paper powders deposited on the surface of the intermediate transfer belt 21 increases, the amount of paper powders deposited on and sticking to the tips of the bristles 8*b* of the paper powder removal brush 201 increases. This easily deteriorates the scraping capability exhibited by the bristles 8*b* as described above.

For this reason, in the case where the printer is placed in a usage environment with a high ratio of print jobs on images having a low coverage rate to the entire print jobs requested by a user, it is possible to maintain a high capability of removing the paper powders and the like exhibited by the paper powder removal brush 201, by setting the increase amount of a single brush contact amount to a higher value than in the case where the printer is placed in a usage environment with a low ratio of print jobs on images having a low coverage rate to the entire requested print jobs.

Figure 14:
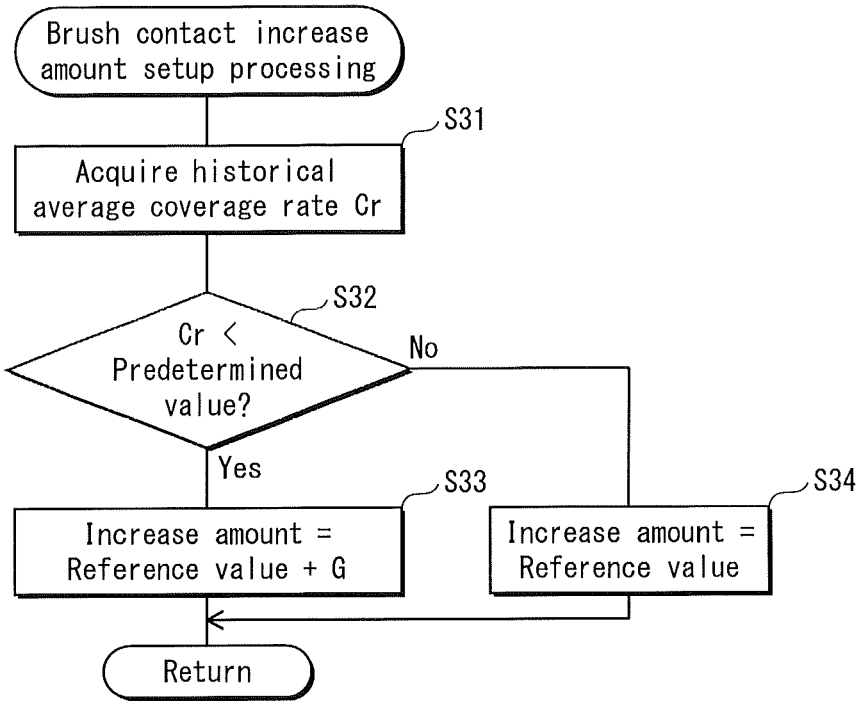
FIG. 14 is a flow chart showing a subroutine of the brush contact increase amount setup processing in accordance with coverage rate.

FIG. 14 is a flow chart showing a subroutine of the brush contact increase amount setup processing in accordance with the coverage rate.

As shown in the figure, the brush displacement subunit 51 acquires a historical average coverage rate Cr (Step S31). The historical average coverage rate Cr indicates an average value of the coverage rate with respect to all print jobs which have been executed from when an immediately previous brush contact amount increase control completes to the current time.

Each time a single brush contact amount increase control completes, the brush displacement subunit 51 obtains a coverage rate with respect to each of the pieces of sheets S in all print jobs to be executed until a next brush contact amount increase control starts. The coverage rate is obtained by calculating, based on image data of a print job, a ratio of the number of pixels constituting parts where toner images are to be formed to the entire area in each of the pieces of sheets S. The coverage rate obtained with respect to each of the pieces of sheets S is stored in a storage unit, which is not illustrated, in units of printing on the sheet S.

In Step S31, the brush displacement subunit 51 reads, from the storage unit, the coverage rate with respect to each of all print jobs which have been executed from when an immediately previous brush contact amount increase control completes to the current time, performs averaging processing on all the read coverage rates, and acquires the averaged coverage rate as the historical average coverage rate Cr.

The brush displacement subunit 51 judges whether or not the historical average coverage rate Cr is lower than a predetermined value (Step S32). This predetermined value is determined in advance by experiments or the like. It is assumed that when the historical average coverage rate Cr is lower than this predetermined value, the increase amount of the brush contact amount needs to be set to a value higher than the reference value.

When judging that the historical average coverage rate Cr is equal to or higher than the predetermined value (Step S32: No), the brush displacement subunit 51 sets the increase amount of the brush contact amount to the reference value (Step S34). Then, the flow returns. When judging that the historical average coverage rate Cr is lower than the predetermined value (Step S32: Yes), the brush displacement subunit 51 sets the increase amount of the brush contact amount to a value resulting from adding a correction value G to the reference value (Step S33). Then, the flow returns.

As a result, in the case where the printer is placed in an environment in most of images to be printed has a low coverage rate, it is possible to set the increase amount of the brush contact amount to a large value in the brush contact amount increase control. This allows a more appropriate brush contact amount increase control depending on the coverage rate.

<Primary Transfer Bias>

The primary transfer bias indicates a transfer voltage or a transfer current that determines the magnitude of an electric filed that acts, with respect to each of the image forming subunits 10Y, 10M, 10C, and 10K, between a corresponding one of the primary transfer rollers 28Y, 28M, 28C, and 28K and a corresponding one of the photosensitive drums 1Y, 1M, 1C, and 1K via the intermediate transfer belt 21.

The primary transfer bias varies in accordance with variation of humidity inside the printer. Specifically, the transfer current excessively flows in accordance with variation from a normal humidity environment to a high humidity environment. As a result, micro toner powders, paper powders, and the like, which would not have been primarily transferred from the photosensitive drums 1Y, 1M, 1C, and 1K onto the surface of the intermediate transfer belt 21 in the normal humidity environment, tend to easily transferred onto the surface of the intermediate transfer belt 21 due to excessive flow of the transfer current. As the amount of micro toner powders and the like, which are deposited on the surface of the intermediate transfer belt 21, increases, the amount of micro toner powders and the like, which are deposited on and stick to the tips of the bristles 8*b* of the paper powder removal brush 201, increases. This easily deteriorates the scraping capability exhibited by the bristles 8*b* as described above.

Therefore, in the case where the printer is placed in an environment where the primary transfer bias easily varies, such as an environment where ambient humidity easily varies, it is possible to maintain a high capability of removing the paper powders and the like exhibited by the paper powder removal brush 201, by setting the increase amount of a single brush contact amount to a higher value than in the case where the printer is placed in an environment where the primary transfer bias varies only to a small degree.

The variation of the primary transfer bias is detected for example by an ammeter measuring a transfer current that is actually flowing through the primary transfer rollers 28Y, 28Y, 28Y, and 28K.

It is possible to execute control to set a different increase amount of the brush contact amount in accordance with whether or not the primary transfer bias exceeds a predetermined value, in other words, whether or not the transfer current excessively flows. The predetermined value is determined in advance by experiments or the like. It is assumed that when the primary transfer bias exceeds the predetermined value, the increase amount of the brush contact amount needs to be set to a value higher than the reference value.

Instead of the configuration of directly detecting the primary transfer bias, it may be possible to use a control method for example of detecting humidity inside the printer, which influences variation of the primary transfer bias, and when the detected humidity exceeds a constant value, judging that the primary transfer bias exceeds the predetermined value, and varying the increase amount of the brush contact amount.

In the above explanation, the increase amount of the brush contact amount is set to either the reference value or a value higher than the reference value, in accordance with the temperature T inside the printer or the coverage rate. However, the brush contact amount does not necessarily need to be increased.

Alternatively, in the case where a particular condition is satisfied, the brush contact amount may be decreased, instead of being increased, by a predetermined value such as 0.05 mm. The particular condition is for example that the historical average coverage rate Cr is higher than a predetermined value to a certain degree, that is, an amount of paper powders deposited on the intermediate transfer belt 21 is quite small, and the transfer efficiency is high to a certain degree, that is, an amount of micro toner powders deposited on the intermediate transfer belt 21 is quite small. The particular condition is regarded as a condition indicating that a growth speed of filming is extremely slow. As long as a certain level of cleaning performance is maintained under such a condition, it is possible to maintain the cleaning performance of the paper powder removal brush 8 for a long period and further prevent the bristles 8*b* from abrading the surface of the intermediate transfer belt 21, by decreasing the current brush contact amount by the predetermined value. This brush contact amount decrease control may be executed based on the primary transfer bias for example, without limiting to the historical average coverage rate Cr.

(5) Modification 2 of Brush Contact Amount Increase Control

In the above explanation, the brush contact amount increase control is executed when the predetermined timing comes, for example, when the cumulative number P of printed sheets reaches any of the multiple numbers of the predetermined value. However, the present invention is not limited to this. This predetermined execution timing may be varied based on a predetermined execution condition such as the temperature inside the printer. This is because of the following reason.

According to the configuration such as described above in which the amount of micro toner powders and the like, which are deposited on the surface of the intermediate transfer belt 21, varies in accordance with variation of the temperature inside the printer, the growth speed of filming is higher in the case where the printer is placed in a high temperature environment that is higher in temperature than a normal temperature environment, compared to in the case where the printer is placed in the normal temperature environment. Accordingly, in the case where the printer is placed in the high temperature environment, it is possible to prevent the filming from growing at an earlier stage, by accelerating the execution timing of the brush contact amount increase control earlier compared to in the case where the printer is placed in the normal temperature environment.

Figure 15:
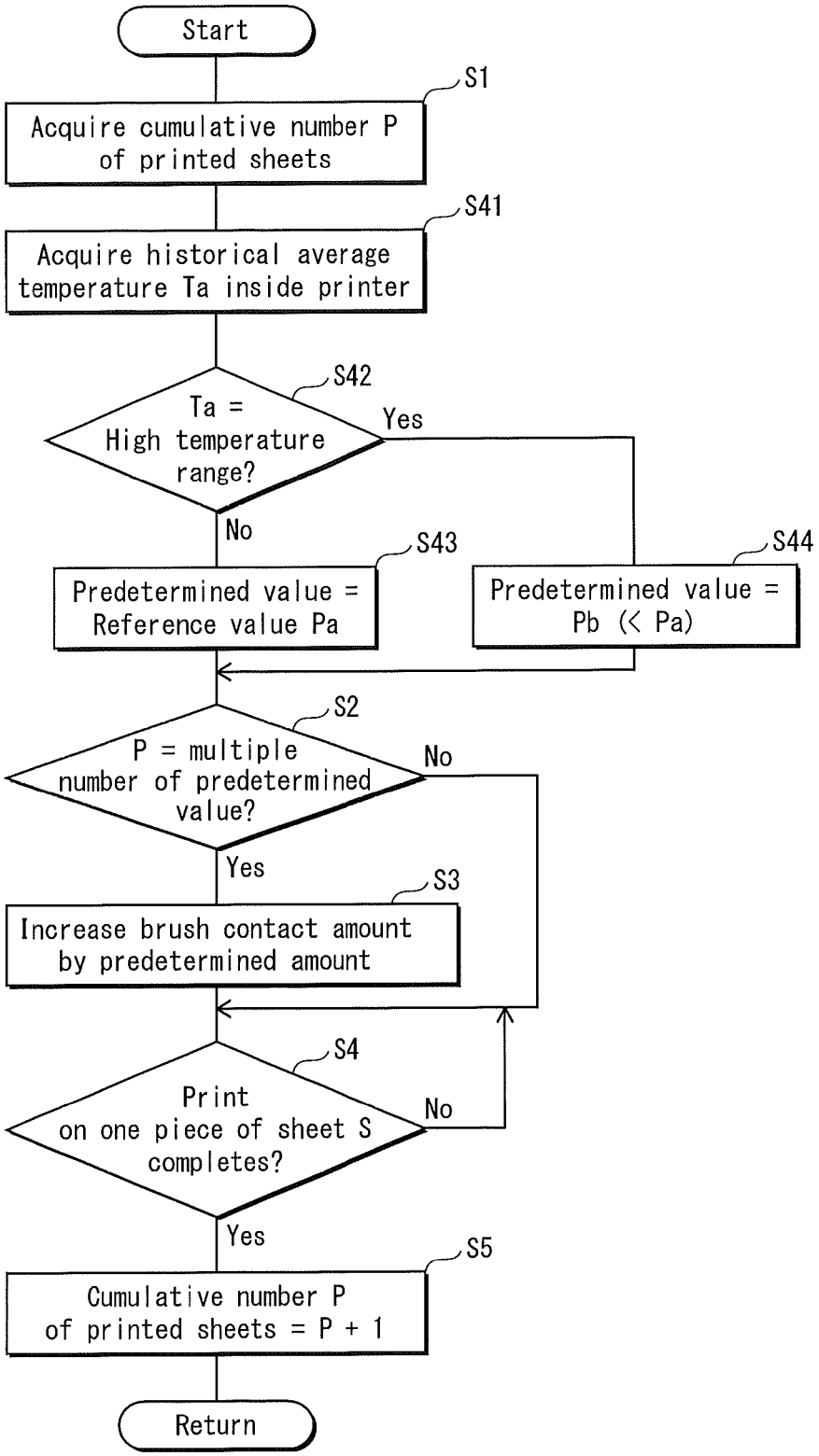
FIG. 15 is a flow chart showing processing of varying a timing of executing the brush contact amount increase control in accordance with the temperature inside the printer.

FIG. 15 is a flow chart showing processing of varying the execution timing of brush contact amount increase control in accordance with the temperature inside the printer. In FIG. 15, Steps S41 to S44 are performed between Steps S1 and S2. This is a different point from FIG. 11. The following explanation focuses on this different point.

Specifically, after acquiring the cumulative number P of printed sheets (Step S1), the brush displacement subunit 51 acquires a historical average temperature Ta inside the printer (Step S41). The historical average temperature Ta inside the printer indicates an average value of the temperature inside the printer with respect to all print jobs which have been executed from when an immediately previous brush contact amount increase control completes to the current time.

Each time a single brush contact amount increase control completes, the brush displacement subunit 51 detects, by using the temperature sensor 208, the temperature T inside the printer with respect to each of print jobs to be executed after completion of the brush contact amount increase control. Then, the brush displacement subunit 51 stores the detected temperature T in the storage unit, which is not illustrated, in units of printing on one piece of sheet S.

In Step S41, the brush displacement subunit 51 reads, from the storage unit, the temperature T inside the printer with respect to each of all print jobs which have been executed from when an immediately previous brush contact amount increase control completes to the current time, performs averaging processing on all the read temperatures T, and acquires the averaged temperature as the historical average temperature Ta inside the printer.

When judging that the historical average temperature Ta inside the printer does not fall within the high temperature range, that is, falls in a temperature range that is lower than the high temperature range (non-high temperature range) (Step S42: No), the brush displacement subunit 51 sets the predetermined value to a reference value Pa such as 100 K (Step S43). Then, the processing proceeds to Step S2.

When judging that the historical average temperature Ta inside the printer falls within the high temperature range (Step S42: Yes), the brush displacement subunit 51 sets the predetermined value to a value Pb such as 80 K that is lower than the reference value Pa (Step S44). Then, the processing proceeds to Step S2.

In Step S2, the brush displacement subunit 51 judges whether or not the cumulative number P of printed sheets, which is acquired in Step S1, is equal to any of the multiple numbers of the predetermined value (Pa or Pb), which is set in Step S43 or S44. When judging that the cumulative number P of printed sheets is equal to any of the multiple numbers of the predetermined value (Pa or Pb) (Step S2: Yes), the brush displacement subunit 51 executes the brush contact amount increase control (Step S3).

In the case where the historical average temperature Ta inside the printer falls within the high temperature range, the predetermined value is set to the value Pb, which is lower than the reference value Pa set in the case where the historical average temperature Ta falls within the non-high temperature range. Accordingly, the execution timing of brush contact amount increase control comes earlier at the historical average temperature Ta inside the printer which falls within the high temperature range, than at the historical average temperature Ta which falls within the non-high temperature range. Therefore, it is possible to prevent, at a further earlier stage, occurrence of filming, which would grow at a high growth speed in the case where the printer is placed in the high temperature environment. Note that the above values Pa and Pb may be each determined in advance as an appropriate value by experiments or the like depending on the device configuration.

The configuration example has been explained above in which the judgment is made as to whether or not to accelerate the execution timing of the brush contact amount increase control than in a normal case in accordance with the historical average temperature Ta inside the printer. However, the present invention is not limited to this. It is only necessary to judge that the brush contact amount increase control needs to be executed by a certain timing comes. For example, the current temperature inside the printer may be used for making the judgment, instead of the historical average temperature Ta inside the printer. Alternatively, the coverage rate, the primary transfer bias, or the like may be used.

The configuration example has been explained above in which the execution timing of the brush contact amount increase control is varied to an earlier timing than in a normal case. However, the present invention is not limited this. In the case where the above particular condition is satisfied for example, the execution timing may be varied to a later timing than in a normal case by a predetermined time period. Varying the execution timing is similarly applicable to the brush contact amount decrease control.

From the above explanation, Embodiments 1 and 2 and Modifications 1 and 2 describe the configuration in which control is executed to vary the distance between the paper powder removal brush 8 and the intermediate transfer belt 21 based on a predetermined condition such as the cumulative number P of printed sheets in order to vary the brush contact amount. Furthermore, this control includes control of varying the increase amount of the brush contact amount based on a predetermined variation condition such as the temperature inside the printer and control of varying an execution timing of the control of varying the increase amount based on a predetermined execution condition such as the temperature inside the printer.

The present invention is not limited to an image forming apparatus, and alternatively may be an image carrier cleaning method executed by an image forming apparatus that cleans an image carrier by varying the brush contact amount. Further alternatively, the present invention may be a program that enables a computer to execute the method. Yet alternatively, a computer program relating to the present invention may be recorded in computer-readable recording media, including for example a magnetic tape, a magnetic disk such as a flexible disk, an optical recording medium such as DVD-ROM, DVD-RAM, CD-ROM, CD-R, MO, and PD, and a flash memory. The computer program may be produced and transferred in the form of such a recording medium, or may be transmitted and provided via various kinds of wired or wireless networks such as the Internet, broadcasting, an electrical communication, a satellite communication, or the like.

<Modifications>

Although the present invention has been explained based on the above embodiments, the present invention is not of course limited to the above embodiments. The present invention may include the following modifications.

(1) In the above embodiments, the configuration example has been explained in which the bristles 8*b* of the paper powder removal brush 8 absorbs and holds therein foreign substances on the intermediate transfer belt 21 such as paper powders and external additive particles. The present invention is not limited to this. Alternatively, the second cleaning subunit 80 for example may include the paper powder removal brush 8 and a collection member (not illustrated) that collects paper powders and the like held in the paper powder removal brush 8.

Specifically, the following configurations may be applied for example: a configuration in which a collection roller as the collection member comes into contact with the paper powder removal brush 8 to collect the paper powders and the like held in the paper powder removal brush 8; and a configuration in which a voltage is applied to at least one of the paper powder removal brush 8 and the collection roller, such that an electric filed, which causes an electrostatic force to act on foreign substances such as paper powders held in the paper powder removal brush 8 in a movement direction from the paper powder removal brush 8 to the collection roller, is generated between the paper powder removal brush 8 and the collection roller.

It is desirable that in the case where the collection roller is caused to come into contact with the paper powder removal brush 8, a configuration should be used in which a friction force due to the contact is reduced as much as possible in order to prevent the microparticles 82 of the bristles 8*b* from detaching from the original yarns 81 or being shaved at an early stage, such as a configuration in which the collection roller is driven by the paper powder removal brush 8 to rotate. In a configuration in which an electrostatic force is used, the collection roller may be caused not to come into contact with the paper powder removal brush 8.

(2) In the above embodiments, the paper powder removal brush 8 is driven by the intermediate transfer belt 21 to rotate. Instead, the paper powder removal brush 8 may be driven by a motor to rotate, for example.

Also in this motor-driven configuration, it is preferable that the difference in peripheral speed between the outer diameter portion of the paper powder removal brush 8 (the tip parts of the bristles 8*b* which are out of contact with the intermediate transfer belt 21) and the surface of the intermediate transfer belt 21 should fall within a predetermined acceptable range. In other words, it is preferable that the difference in peripheral speed should be zero or should fall within the acceptable range if the difference occurs. The acceptable range is determined in advance by experiments or the like as a range according to which scratches and abrasion, which gradually occur on the surface of the intermediate transfer belt 21 due to the difference in peripheral speed, do not influence the operating life of the intermediate transfer belt 21 and the paper powder removal brush 8.

Also, the configuration example has been explained with reference to FIG. 1 above in which the paper powder removal brush 8 rotates in the movement direction of the surface of the intermediate transfer belt 21, at the contact position where the paper powder removal brush 8 is in contact with the surface of the intermediate transfer belt 21. However, the present invention is not limited to this. Alternatively, for example, in a device configuration that does not influence the operating life of the intermediate transfer belt 21 and the paper powder removal brush 8, the rotation direction of the paper powder removal brush 8 may be counter to the movement direction of the surface of the intermediate transfer belt 21.

Note that the paper powder removal brush 8 is a rotary body in the above embodiments. However, the paper powder removal brush 8 is not limited to be a rotary body, and alternatively may be for example a brush that is a non-rotary body and is fixed and supported.

(3) In the above embodiments, the configuration example has been explained in which the belt cleaning unit 60 including the paper powder removal brush 8 is applied for cleaning the intermediate transfer belt 21 onto which respective toner images of the Y, M, C, and K colors are multi-transferred. However, the present invention is not limited to this. Alternatively, a cleaning unit having the same configuration as the belt cleaning unit 60 may be for example applicable as a cleaner to each of the photosensitive drums 1Y, 1M, 1C, and 1K.

Also, the configuration example has been explained in which the first cleaning subunit 70 includes the two cleaning brushes 71 and 72. However, the present invention is not limited to this. The first cleaning subunit 70 only needs to be a cleaning member that is capable of removing residues such as residual toners remaining on the intermediate transfer belt 21 after secondary transfer. For example, the first cleaning subunit 70 may be a single cleaning brush, a single cleaning blade, a combination of the single cleaning brush and the cleaning blade, or the like.

(4) In the above embodiments, the example has been explained in which the image forming apparatus relating to the present invention is applied to a tandem-type color printer. However, the present invention is not limited to this. The image forming apparatus relating to the present invention is applicable to an image forming apparatus having a function of forming monochrome images instead of colored images.

The image forming apparatus relating to the present invention may be an image forming apparatus that transfers a toner image formed on an image carrier having a moving surface onto a transfer object, the image forming apparatus comprising: a cleaning member that performs a removal operation on residues remaining on the image carrier after transfer of the toner image; and a brush member that comes into contact with the image carrier, on a downstream side relative to the cleaning member in a movement direction of the surface of the image carrier, to remove part of the residues that remains unremoved on the image carrier even after the removal operation performed by the cleaning member. Bristles of the brush member may include original yarns with uneven surfaces formed by microparticles adhering to and coating the original yarns. The image forming apparatus with the configuration of the above cleaning member and brush member is applicable to general image forming apparatuses such as copiers, facsimiles, and multiple function peripherals (MFPs).

The image carrier relating to the present invention is not limited to the intermediate transfer belt 21, and only needs to have a surface that moves by rotation or the like. The image carrier may be for example an intermediate transfer drum, a photosensitive belt, or the like. Also, the transfer object is not limited to a recording sheet. According to a configuration in which, for example, toner images on a first intermediate transfer member are transferred onto another second intermediate transfer member and then transferred onto a recording sheet, the first intermediate transfer member may be regarded as the image carrier and the second intermediate transfer member may be regarded as the transfer object.

Also, according to a configuration in which toner images on an intermediate transfer belt are transferred onto a heat fixing belt, and then the transferred toner images are fixed to a recording sheet at a fixing position, the intermediate transfer belt may be regarded as the image carrier and the fixing belt may be regarded as the transfer object.

Furthermore; the present invention may be any combination of the above embodiments and modifications.

SUMMARY

The above embodiments and modifications each show one aspect for solving the problem described in the section RELATED ART, and are summarized as follows.

Specifically, one aspect of the present invention provides an image forming apparatus that transfers a toner image formed on an image carrier having a moving surface onto a transfer object, the image forming apparatus comprising: a cleaning member that performs a removal operation on residues remaining on the image carrier after transfer of the toner image; and a brush member that has bristles including original yarns with uneven surfaces formed by microparticles adhering to and coating the original yarns, and comes into contact with the image carrier, on a downstream side relative to the cleaning member in a movement direction of the surface of the image carrier, to remove part of the residues that remains unremoved on the image carrier even after the removal operation performed by the cleaning member.

Also, the brush member may be a rotary body, and the brush member may rotate so as to move in the movement direction of the surface of the image carrier at a contact position therebetween.

Also, an outer diameter portion of the brush member may be equal to the surface of the image carrier in terms of peripheral speed.

Also, the brush member may be driven to rotate by the contact with the moving surface of the image carrier.

Also, the microparticles may charge to a polarity opposite to a polarity of the unremoved part of the residues.

Also, the image forming apparatus may further comprise a collection member that collects removed part of the residues, the removed part having been removed by the cleaning member, wherein the cleaning member may be a rotary body that has bristles including original yarns whose surfaces do not have microparticles adhered thereto, and the collection member may come into contact with the bristles of the cleaning member to collect the removed part of the residues that is absorbed into the bristles of the cleaning member.

Also, the image forming apparatus may further comprise: a movement unit that moves at least one of the brush member and the image carrier in a direction relatively away from each other and a direction relatively toward each other; and a control unit that controls the movement unit to vary a distance between the brush member and the image carrier based on a predetermined condition.

Also, the predetermined condition may indicate whether or not a predetermined timing comes for increasing a current contact length by a predetermined increase amount, the contact length indicating a Length of tip parts of the bristles of the brush member that are in contact with the surface of the image carrier, and when the predetermined timing comes, the control unit may reduce the distance by a distance corresponding to the increase amount.

Also, the control unit may vary the increase amount based on a predetermined variation condition.

Also, the predetermined variation condition may indicate whether or not a current temperature inside the image forming apparatus or a historical average temperature inside the image forming apparatus falls within a first temperature range, and when the current temperature or the historical average temperature falls within the first temperature range, the control unit may increase the increase amount more than when the current temperature or the historical average temperature falls within a second temperature range that is lower than the first temperature range.

Also, the predetermined variation condition may indicate whether or not a historical average coverage rate of executed jobs is lower than a predetermined value, and when the historical average coverage rate is lower than the predetermined value, the control unit may increase the increase amount more than when the historical average coverage rate is equal to or higher than the predetermined value.

Also, the control unit may vary the predetermined timing based on a predetermined execution condition.

Also, the predetermined execution condition may indicate whether or not a current temperature inside the image forming apparatus or a historical average temperature inside the image forming apparatus falls within a first temperature range, and when the current temperature or the historical average temperature falls within the first temperature range, the control unit may accelerate the predetermined timing earlier than when the current temperature or the historical average temperature falls within a second temperature range that is lower than the first temperature range.

Also, the unremoved part of the residues may be smaller than the microparticles of the brush member in terms of particle diameter, and the brush member may remove the unremoved part by absorbing the unremoved part into concave portions on the surfaces of the bristles thereof.

With the above configuration, most part (such as residual toners) of residues on the image carrier is first removed by the cleaning member, and then part (such as paper powders and external additive particles) of the residues, which remains unremoved even after the removal operation by the cleaning member, is cleaned by the brush member having the bristles whose surfaces have the uneven shape.

Compared to bristles of a brush whose surfaces do not have the uneven shape, the bristles of the brush whose surfaces have the uneven shape exhibit a high capability of mechanically scarping the unremoved part of the residues on the image carrier such as paper powders with use of the convex portions on the surfaces with the uneven shape and a high capability of absorbing and collecting the unremoved part of the residues such as paper powders owing to a further increased surface area of the bristles. Furthermore, since the brush member is disposed on the downstream side relative to the cleaning member in the movement direction of the surface of the image carrier, it is possible to prevent a phenomenon that much of residual toners on the image carrier is deposited on and sticks to the bristles of the brush member.

This allows the bristles of the brush member with the uneven shape to continuously exhibit the effects of removing paper powders, external additive particles, and the like for a long period, and thereby to prevent early occurrence of filming. As a result, the cleaning performance is further improved.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus that transfers a toner image formed on an image carrier having a moving surface onto a transfer object, the image forming apparatus comprising:

a cleaning member that performs a removal operation on residues remaining on the image carrier after transfer of the toner image; and a brush member that has bristles including original yarns with uneven surfaces formed by microparticles adhering to and coating the original yarns, and comes into contact with the image carrier, on a downstream side relative to the cleaning member in a movement direction of the surface of the image carrier, to remove part of the residues that remains unremoved on the image carrier even after the removal operation performed by the cleaning member, wherein the unremoved part of the residues is smaller than the microparticles of the brush member in terms of particle diameter, and the brush member removes the unremoved part by absorbing the unremoved part into concave portions on the surfaces of the bristles thereof.

2. The image forming apparatus of claim 1, wherein the brush member is a rotary body, and the brush member rotates so as to move in the movement direction of the surface of the image carrier at a contact position therebetween.

3. The image forming apparatus of claim 2, wherein an outer diameter portion of the brush member is configured to have a peripheral speed equal to that of the surface of the image carrier.

4. The image forming apparatus of claim 3, wherein the brush member is driven to rotate by the contact with the moving surface of the image carrier.

5. The image forming apparatus of claim 1, wherein the microparticles charge to a polarity opposite to a polarity of the unremoved part of the residues.

6. An image forming apparatus that transfers a toner image formed on an image carrier having a moving surface onto a transfer object, the image forming apparatus comprising:

a cleaning member that performs a removal operation on residues remaining on the image carrier after transfer of the toner image;

a brush member that has bristles including original yarns with uneven surfaces formed by microparticles adhering to and coating the original yarns, and comes into contact with the image carrier, on a downstream side relative to the cleaning member in a movement direction of the surface of the image carrier, to remove part of the residues that remains unremoved on the image carrier even after the removal operation performed by the cleaning member; and a collection member that collects removed part of the residues, the removed part having been removed by the cleaning member, wherein the cleaning member is a rotary body that has bristles including original yarns whose surfaces do not have microparticles adhered thereto, and the collection member comes into contact with the bristles of the cleaning member to collect the removed part of the residues that is absorbed into the bristles of the cleaning member.

7. An image forming apparatus that transfers a toner image formed on an image carrier having a moving surface onto a transfer object, the image forming apparatus comprising:

a cleaning member that performs a removal operation on residues remaining on the image carrier after transfer of the toner image;

a brush member that has bristles including original yarns with uneven surfaces formed by microparticles adhering to and coating the original yarns, and comes into contact with the image carrier, on a downstream side relative to the cleaning member in a movement direction of the surface of the image carrier, to remove part of the residues that remains unremoved on the image carrier even after the removal operation performed by the cleaning member;

a movement unit that moves at least one of the brush member and the image carrier in a direction relatively away from each other and a direction relatively toward each other; and a control unit that controls the movement unit to vary a distance between the brush member and the image carrier based on a predetermined condition.

8. The image forming apparatus of claim 7, wherein the predetermined condition indicates whether or not a predetermined timing comes for increasing a current contact length by a predetermined increase amount, the contact length indicating a length of tip parts of the bristles of the brush member that are in contact with the surface of the image carrier, and when the predetermined timing comes, the control unit reduces the distance by a distance corresponding to the increase amount.

9. The image forming apparatus of claim 8, wherein the control unit varies the increase amount based on a predetermined variation condition.

10. The image forming apparatus of claim 9, wherein the predetermined variation condition indicates whether or not a current temperature inside the image forming apparatus or a historical average temperature inside the image forming apparatus falls within a first temperature range, and when the current temperature or the historical average temperature falls within the first temperature range, the control unit increases the increase amount more than when the current temperature or the historical average temperature falls within a second temperature range that is lower than the first temperature range.

11. The image forming apparatus of claim 9, wherein the predetermined variation condition indicates whether or not a historical average coverage rate of executed jobs is lower than a predetermined value, and when the historical average coverage rate is lower than the predetermined value, the control unit increases the increase amount more than when the historical average coverage rate is equal to or higher than the predetermined value.

12. The image forming apparatus of claim 8, wherein the control unit varies the predetermined timing based on a predetermined execution condition.

13. The image forming apparatus of claim 12, wherein the predetermined execution condition indicates whether or not a current temperature inside the image forming apparatus or a historical average temperature inside the image forming apparatus falls within a first temperature range, and when the current temperature or the historical average temperature falls within the first temperature range, the control unit accelerates the predetermined timing earlier than when the current temperature or the historical average temperature falls within a second temperature range that is lower than the first temperature range.

* * * * *